US011174556B2

(12) United States Patent
Endo et al.

(10) Patent No.: US 11,174,556 B2
(45) Date of Patent: Nov. 16, 2021

(54) SURFACE-TREATMENT SOLUTION FOR ZINC OR ZINC ALLOY COATED STEEL SHEET, METHOD OF PRODUCING ZINC OR ZINC ALLOY COATED STEEL SHEET WITH SURFACE-COATING LAYER, AND ZINC OR ZINC ALLOY COATED STEEL SHEET WITH SURFACE-COATING LAYER

(71) Applicant: JFE STEEL CORPORATION, Chiyoda-ku Tokyo (JP)

(72) Inventors: Reona Endo, Tokyo (JP); Kazuhisa Okai, Tokyo (JP); Hiroshi Kajiyama, Tokyo (JP); Takashi Kawano, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 373 days.

(21) Appl. No.: 16/340,134

(22) PCT Filed: Oct. 6, 2017

(86) PCT No.: PCT/JP2017/036441
§ 371 (c)(1),
(2) Date: Apr. 8, 2019

(87) PCT Pub. No.: WO2018/070350
PCT Pub. Date: Apr. 19, 2018

(65) Prior Publication Data

US 2019/0242018 A1 Aug. 8, 2019

(30) Foreign Application Priority Data

Oct. 11, 2016 (JP) ..... JP2016-200391

(51) Int. Cl.
*C23C 22/60* (2006.01)
*C23C 22/82* (2006.01)
(Continued)

(52) U.S. Cl.
CPC ..... *C23C 22/60* (2013.01); *C23C 22/82* (2013.01); *C23C 26/00* (2013.01); *C23C 2/06* (2013.01);
(Continued)

(58) Field of Classification Search
CPC ..... C23C 22/60; C23C 2222/20
See application file for complete search history.

(56) References Cited

U.S. PATENT DOCUMENTS 9,051,654 B2 6/2015 Matsuda et al.
9,187,829 B2 11/2015 Kaneko et al.
2014/0342180 A1* 11/2014 Kaneko ..... B05D 3/00 428/626

FOREIGN PATENT DOCUMENTS

CN 103797157 A 5/2014
CN 105814237 A 7/2016
(Continued)

OTHER PUBLICATIONS

Feb. 10, 2021, Office Action issued by the Korean Intellectual Property Office in the corresponding Korean Patent Application No. 10-2019-7013368 with English language concise statement of relevance.
(Continued)

*Primary Examiner* — Lois L Zheng
(74) *Attorney, Agent, or Firm* — Kenja IP Law PC

(57) ABSTRACT

Disclosed is a surface-treatment solution for producing a zinc or zinc alloy coated steel sheet with a surface-coating layer that does not contain a chromium compound in the surface-coating layer and that is excellent in all of heat discoloration resistance, heat cracking resistance, planar part anti-corrosion property, corrosion resistance after alkali degreasing, blackening resistance, stack blackening resistance, anti-water stain property, solvent resistance, perspiration resistance, coating adhesion property, and storage
(Continued)

stability. The disclosed surface-treatment solution contains a glycidyl group-containing silane coupling agent (A), a tetraalkoxysilane (B), a zirconium carbonate compound (C), and an anionic polyurethane resin (D) having a glass transition temperature (Tg) of 80° C. to 130° C., a vanadium compound (E), a molybdic acid compound (F), and water, the surface-treatment solution having a pH of 8.0 to 10.0, and the amount of each component satisfying a predetermined relationship.

10 Claims, 1 Drawing Sheet

(51) Int. Cl.

| | |
|---|---|
| ***C23C 26/00*** | (2006.01) |
| *C23C 22/00* | (2006.01) |
| *C23C 2/26* | (2006.01) |
| *C23C 2/06* | (2006.01) |
| *C23C 28/00* | (2006.01) |
| *C23C 22/78* | (2006.01) |

(52) U.S. Cl.
CPC ..... *C23C 2/26* (2013.01); *C23C 22/78* (2013.01); *C23C 28/00* (2013.01); *C23C 2222/20* (2013.01)

(56) References Cited

FOREIGN PATENT DOCUMENTS

| | | | |
|---|---|---|---|
| EP | 2495351 | A1 | 9/2012 |
| JP | 2007177314 | A | 7/2007 |
| JP | 2008291350 | A | 12/2008 |
| JP | 2010156020 | A | 7/2010 |
| JP | 2011117070 | A | 6/2011 |
| JP | 2013060646 | A | 4/2013 |
| JP | 2014055319 | A | 3/2014 |
| JP | 2014101562 | A | 6/2014 |
| JP | 2014156615 | A | 8/2014 |
| JP | 2015175003 | A | 10/2015 |
| JP | 2016037620 | A | 3/2016 |
| WO | 2007069783 | A1 | 6/2007 |
| WO | 2013022118 | A1 | 2/2013 |

OTHER PUBLICATIONS

Sep. 27, 2019, the Extended European Search Report issued by the European Patent Office in the corresponding European Patent Application No. 17859809.0.
Nov. 14, 2017, International Search Report issued in the International Patent Application No. PCT/JP2017/036441.
Aug. 20, 2020, Office Action issued by the China National Intellectual Property Administration in the corresponding Chinese Patent Application No. 201780062677.X with English language search report.

* cited by examiner

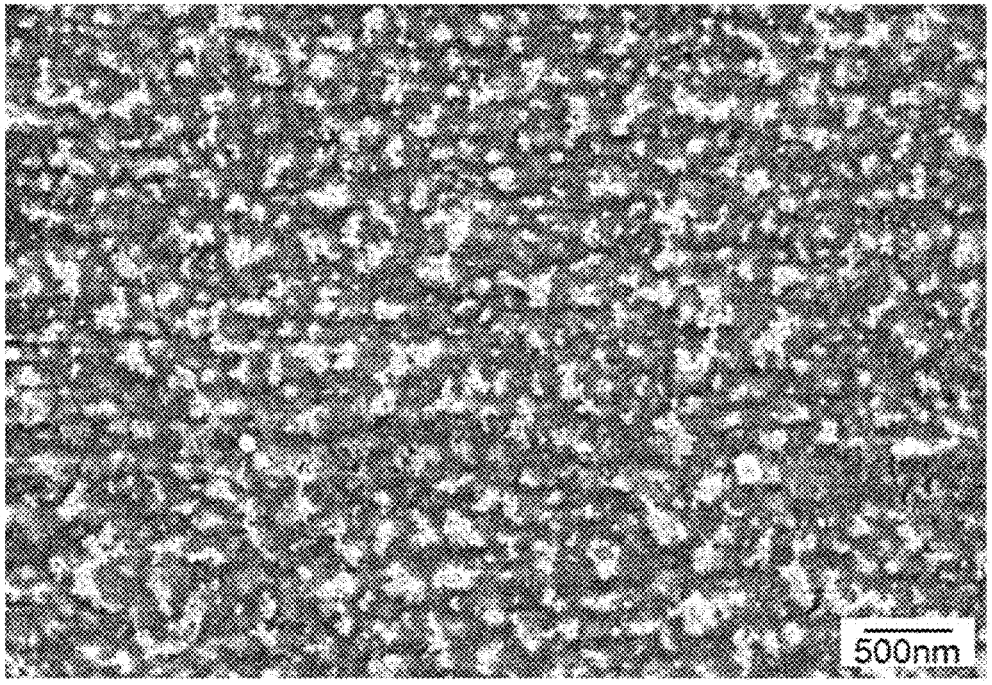
500nm

SURFACE-TREATMENT SOLUTION FOR ZINC OR ZINC ALLOY COATED STEEL SHEET, METHOD OF PRODUCING ZINC OR ZINC ALLOY COATED STEEL SHEET WITH SURFACE-COATING LAYER, AND ZINC OR ZINC ALLOY COATED STEEL SHEET WITH SURFACE-COATING LAYER

TECHNICAL FIELD

This disclosure relates to a surface-treatment solution for a zinc or zinc alloy coated steel sheet, a method of producing a zinc or zinc alloy coated steel sheet with a surface-coating layer, and a zinc or zinc alloy coated steel sheet with a surface-coating layer.

BACKGROUND

Zinc or zinc alloy coated steel sheets that are surface-treated by chromating using a treatment solution mainly composed of chromic acid, dichromic acid, or salts thereof to improve the corrosion resistance (anti-white rust property, anti-red rust property) have conventionally been in wide use. Recent global environmental issues, however, have increased the demand for use of non-polluting steel sheets surface-treated not by chromating, namely, chromium-free treated steel sheets.

Such a zinc or zinc alloy coated steel sheet with a surface-coating layer (hereinafter also referred to as a "coated steel sheet") is used for automobiles, household electrical appliances, office automation equipment, construction materials, and the like. When used in these applications, they are often exposed to the atmosphere without coating as outer plates and the like, and users are requesting products with aesthetic surface appearance. In particular, if remarkable alteration or discoloration on the surface appearance is observed over time from the production until the user's use, the product value is lowered. On the other hand, zinc or zinc alloy coated steel sheets undergo a phenomenon of "blackening" that changes color from gray to black as a result of oxidation of the surface due to aging, and the blackening becomes more pronounced particularly when zinc or zinc alloy coated steel sheets have a coated layer containing elements such as Mg and Al, which are more easily oxidized than Zn. Although blackening phenomenon is suppressed to some extent by applying a surface-coating layer, especially when steel sheets are transported and stored under the condition that they are overlapped in coils over a long period of time under a high-temperature and high-humidity environment, which is a very severe environment in which oxygen supply is insufficient and water supply is abundant, formation of oxygen-deficient zinc oxide, which is the main factor of blackening, is markedly promoted, and the steel sheets are more prone to blackening. In addition, there is a tradeoff between the planar part anti-corrosion property required for coated steel sheets and the blackening resistance, and none of the conventional techniques achieve both planar part anti-corrosion property and blackening resistance at the same time under harsh environments.

Therefore, there is a need for a coated steel sheet that is excellent in blackening resistance and planar part anti-corrosion property, and that suppresses the above phenomenon. Further, considering that coated steel sheets are used for various purposes, it is also required for a coated steel sheet to have excellent corrosion resistance after alkali degreasing, anti-water stain property, solvent resistance, perspiration resistance, coating adhesion property, and storage stability. In the case of further welding, it is also required for a coated steel sheet to have excellent heat discoloration resistance and heat cracking resistance.

JP2015175003A (PTL 1) and JP201637620A (PTL 2) describe techniques for imparting excellent planar part anti-corrosion property and blackening resistance by applying a surface-treatment solution to a zinc or zinc alloy coated steel sheet and drying it to form a surface-coating layer, wherein the surface-treatment solution contains: a hydrolyzable group-containing silane compound obtained from a glycidyl group-containing silane coupling agent, a tetraalkoxysilane, and a phosphonic acid; a zirconium carbonate compound; and a vanadic acid compound. However, since the surface-coating layer has a polysiloxane bond as a main skeleton by a condensation reaction of a silane compound, visually-observable cracks easily occur due to thermal decomposition of the polysiloxane bond upon heating at a high temperature exceeding 500° C. Furthermore, due to the existence of many hard components derived from the zirconium carbonate compound, coating adhesion can not be sufficiently secured. In addition, corrosion resistance, coating adhesion property, and lubricity are not sufficient.

JP2011117070A (PTL 3) describes a technique for imparting planar part anti-corrosion property, coating adhesion property, conductivity, lubricity, and storage stability by forming a first layer and a second layer on a zinc or zinc alloy coated steel sheet, wherein the first layer contains a metal compound containing at least one selected from the group consisting of vanadic acid, Ti, Al, and Zn, in addition to a water-soluble zirconium compound, a tetraalkoxysilane, an epoxy group-containing compound, a chelating agent, and a silane coupling agent, and the second layer contains an organic resin and is over-coated on the surface of the first layer. However, although an organic resin is used in the upper layer for ensuring planar part anti-corrosion property, the upper layer contains a large amount of a metal compound containing at least one selected from the group consisting of a vanadic acid compound, Ti, Al, and Zn, which are components in the lower layer. Such metal compounds promote oxidation of the coating surface as an eluting component under severe conditions in a high-temperature and high-humidity environment. Thus, it is not possible to secure adequate blackening resistance.

JP2008291350A (PTL 4) describes a technique for imparting planar part anti-corrosion property and blackening resistance by forming a surface-coating layer containing a specific titanium-containing aqueous liquid, a nickel compound, and/or a cobalt compound, and a fluorine-containing compound. However, since the fluorine-containing compound, as an eluting component, promotes the oxidation of the coating surface under severe conditions in a high-temperature and high-humidity environment, sufficient blackening resistance can not be ensured. Furthermore, PTL 4 does not consider, for example, anti-water stain property, perspiration resistance, heat discoloration resistance, and heat cracking resistance, and is not sufficient.

JP201360646A (PTL 5) and PTL 6 (JP2014101562A) describe techniques for imparting planar part anti-corrosion property, blackening resistance, and anti-water stain property by forming a surface-coating layer containing a specific titanium-containing aqueous liquid, a nickel compound, a fluorine-containing compound, an organic phosphoric acid compound, and a vanadic acid compound. Furthermore, JP2010156020A (PTL 7) describes a technique for imparting corrosion resistance and coating adhesion property by forming a surface-coating layer containing a titanium-containing aqueous solution, a fluorine-containing compound, an anionic urethane resin and/or an anionic epoxy resin, an organic phosphoric acid compound, a vanadic acid compound, a zirconium carbonate compound, and a glycidyl group-containing silane coupling agent. However, when containing a fluorine-containing compound or an organic phosphoric acid compound, the yellow discoloration of the layer tends to become conspicuous upon heating at a high temperature exceeding 500° C., and the appearance is impaired. PTL 7 does not consider, for example, perspiration resistance, solvent resistance, and heat cracking resistance, and is not sufficient.

CITATION LIST

Patent Literature

PTL 1: JP2015175003A
PTL 2: JP201637620A
PTL 3: JP2011117070A
PTL 4: JP2008291350A
PTL 5: JP201360646A
PTL 6: JP2014101562A
PTL 7: JP2010156020A

SUMMARY

Technical Problem

As described above, none of the conventional coated steel sheets are capable of satisfying both planar part anti-corrosion property and blackening resistance in a severe environment and satisfying all other characteristics in a well-balanced manner. In particular, blackening resistance tends to be problematic when steel sheets are transported and stored under the condition that they are overlapped in coils over a long period of time under a high-temperature and high-humidity environment, which is a more severe environment in which oxygen supply is insufficient and water supply is abundant. As used herein, the blackening resistance to be evaluated in a high-temperature and high-humidity environment in a state where the steel sheets are overlapped is referred to as "stack blackening resistance". There are no steel sheets capable of providing good stack blackening resistance while satisfying all the above-mentioned characteristics in a well-balanced manner.

It would thus be helpful to provide a zinc or zinc alloy coated steel sheet with a surface-coating layer that does not contain a chromium compound in the surface-coating layer and that is excellent in all of heat discoloration resistance, heat cracking resistance, planar part anti-corrosion property, corrosion resistance after alkali degreasing, blackening resistance, stack blackening resistance, anti-water stain property, solvent resistance, perspiration resistance, coating adhesion property, and storage stability, as well as a surface-treatment solution and a method for producing the same.

Solution to Problem

As a result of extensive studies, the inventors found that the above problems can be solved by forming a surface-coating layer on a zinc or zinc alloy coated steel sheet using a surface-treatment solution containing a glycidyl group-containing silane coupling agent (A), a tetraalkoxysilane (B), a zirconium carbonate compound (C), an anionic polyurethane resin (D) having a glass transition temperature (Tg) of 80° C. to 130° C., a vanadium compound (E), a molybdic acid compound (F), and water, the surface-treatment solution having a pH of 8.0 to 10.0, and the amount of each component satisfying a predetermined relationship. In particular, in order to improve stack blackening resistance, it is effective to add the zirconium carbonate compound (C) to the surface-treatment solution, and it is important to set the amount thereof to 45 mass % or more with respect to the total mass ($X_S$) of the components (A) to (C).

The present disclosure is based on the aforementioned discoveries and the primary features thereof are as follows.

[1] A surface-treatment solution for a zinc or zinc alloy coated steel sheet containing a glycidyl group-containing silane coupling agent (A), a tetraalkoxysilane (B), a zirconium carbonate compound (C), and an anionic polyurethane resin (D) having a glass transition temperature (Tg) of 80° C. to 130° C., a vanadium compound (E), a molybdic acid compound (F), and water, the surface-treatment solution having a pH of 8.0 to 10.0, and the amount of each component satisfying: (1) a mass ratio ($X_S/D_S$) of a total mass ($X_S$) of a solid content mass ($A_S$) of the glycidyl group-containing silane coupling agent (A), a solid content mass ($B_S$) of the tetraalkoxysilane (B), and a $ZrO_2$ equivalent mass ($C_Z$) in the zirconium carbonate compound (C) to a solid content mass ($D_S$) of the anionic polyurethane resin (D) is from 0.05 to 0.35; (2) a mass ratio ($A_S/X_S$) of the solid content mass ($A_S$) of the glycidyl group-containing silane coupling agent (A) to the total mass ($X_S$) is from 0.20 to 0.40; (3) a mass ratio ($B_S/X_S$) of the solid content mass ($B_S$) of the tetraalkoxysilane (B) to the total mass ($X_S$) is from 0.010 to 0.30; (4) a mass ratio ($C_Z/X_S$) of the $ZrO_2$ equivalent mass ($C_Z$) in the zirconium carbonate compound (C) to the total mass ($X_S$) is from 0.45 to 0.70; (5) a mass ratio ($E_V/(X_S+D_S)$) of a V equivalent mass ($E_V$) in the vanadium compound (E) to a total mass ($X_S+D_S$) of the total mass ($X_S$) and the solid content mass ($D_S$) of the anionic polyurethane resin (D) is from 0.0010 to 0.015; and (6) a mass ratio ($F_M/(X_S+D_S)$) of a Mo equivalent mass ($F_M$) in the molybdic acid compound (F) to the total mass ($X_S+D_S$) of the total mass ($X_S$) and the solid content mass ($D_S$) of the anionic polyurethane resin (D) is from 0.0010 to 0.015.

[2] The surface-treatment solution for a zinc or zinc alloy coated steel sheet according to [1], further containing a sodium silicate (G), wherein the amount thereof satisfies: (7) a mass ratio ($G_S/(X_S+G_S)$) of a solid content mass ($G_S$) of the sodium silicate (G) to the total mass ($X_S+G_S$) of the total mass ($X_S$) and the solid content mass ($G_S$) of the sodium silicate (G) is less than 0.05, inclusive of 0.00.

[3] The surface-treatment solution for a zinc or zinc alloy coated steel sheet according to [1] or [2], further containing a wax (H), wherein the amount thereof satisfies: (8) a mass ratio ($H_S/(X_S+D_S)$ of a solid content mass ($H_S$) of the wax (H) to the total mass ($X_S+D_S$) of the total mass ($X_S$) and the solid content mass ($D_S$) of the anionic polyurethane resin (D) is from 0.002 to 0.10.

[4] A method of producing a zinc or zinc alloy coated steel sheet with a surface-coating layer, comprising: a first step of applying the surface-treatment solution as recited in any one of [1] to [3] to a surface of a zinc or zinc alloy coated steel sheet; and a second step of subsequently drying the applied surface-treatment solution to form a surface-coating layer having a coating weight of 50 mg/m$^2$ to 2,000 mg/m$^2$.

[5] The method of producing a zinc or zinc alloy coated steel sheet with a surface-coating layer according to [4], wherein $T_S$ is 15° C. to 55° C., $T_L$ is 10° C. to 40° C., and $\Delta T$ is 5° C. to 40° C., where $T_S$ and $T_L$ represent a temperature of the zinc or zinc alloy coated steel sheet and a temperature of the surface-treatment solution in the first step, respectively, and $\Delta T$ represents $T_S-T_L$, and the second step includes a preliminary drying step of drying the applied surface-treatment solution in the atmosphere for a time t seconds, and a heating and drying step of subsequently heating and drying the applied surface-treatment solution in a drying furnace, wherein ΔT/t is 1° C./s to 60° C./s.

[6] A zinc or zinc alloy coated steel sheet with a surface-coating layer, comprising: a zinc or zinc alloy coated steel sheet; and a surface-coating layer having a coating weight of 50 mg/m$^2$ to 2,000 mg/m$^2$ obtained by applying the surface-treatment solution as recited in any one of [1] to [3] to a surface of the zinc or zinc alloy coated steel sheet, and drying the applied surface-treatment solution.

[7] The zinc or zinc alloy coated steel sheet with a surface-coating layer according to [6], wherein the surface-coating layer is formed by a Zr-containing phase and a Zr-free phase, and the Zr-containing phase has a volume fraction of 5% to 40%.

[8] The zinc or zinc alloy coated steel sheet with a surface-coating layer according to [6] or [7], wherein the zinc or zinc alloy coated steel sheet is a hot-dip Zn—Al alloy coated steel sheet comprising a hot-dip Zn—Al alloy coated layer formed on at least one surface of a base steel sheet, the hot-dip Zn—Al alloy coated layer containing (consisting of), by mass %, Al: 3.0% to 6.0%, Mg: 0.2% to 1.0%, and Ni: 0.01% to 0.10%, with the balance being Zn and inevitable impurities.

Advantageous Effect

The zinc or zinc alloy coated steel sheet with a surface-coating layer according to the present disclosure does not contain a chromium compound in the surface-coating layer and is excellent in all of heat discoloration resistance, heat cracking resistance, planar part anti-corrosion property, corrosion resistance after alkali degreasing, blackening resistance, stack blackening resistance, anti-water stain property, solvent resistance, perspiration resistance, coating adhesion property, and storage stability.

Further, the surface-treatment solution and the production method according to the disclosure can produce a zinc or zinc alloy coated steel sheet with a surface-coating layer having the above-mentioned excellent characteristics.

BRIEF DESCRIPTION OF THE DRAWING

FIG. 1 is an SEM image of a surface of a surface-coating layer in Example No. 164.

DETAILED DESCRIPTION

<Zinc or Zinc Alloy Coated Steel Sheet>

Examples of the zinc or zinc alloy coated steel sheet used in the disclosure include: an electrogalvanized steel sheet, a hot-dip galvanized steel sheet, a Zn—Al alloy coated steel sheet, a Zn—Fe alloy coated steel sheet, a Zn—Mg alloy coated steel sheet, a Zn—Al—Mg alloy coated steel sheet, and the like.

More preferably, the zinc or zinc-alloy coated steel sheet may be a hot-dip Zn—Al alloy coated steel sheet comprising a hot-dip Zn—Al alloy coated layer formed on at least one surface of a base steel sheet, the hot-dip Zn—Al alloy coated layer containing, by mass %, Al: 3.0% to 6.0%, Mg: 0.2% to 1.0%, and Ni: 0.01% to 0.10%, with the balance being Zn and inevitable impurities. This steel sheet has an advantage that it exhibits better red rust resistance than other coated steel sheets configured otherwise. It is thus advantageous when used in a more severe corrosive environment such as outdoor. More preferably, the hot-dip Zn—Al alloy coated steel sheet contains a Zn—Al—Mg eutectic alloy in the hot-dip Zn—Al alloy coated layer. The Zn—Al—Mg eutectic alloy is preferably contained in an area ratio of 1% to 50% on the surface of the coated layer.

The zinc or zinc alloy coated steel sheet with a surface-coating layer according to the disclosure comprises: a zinc or zinc alloy coated steel sheet; and a surface-coating layer (hereinafter also simply referred to as a "layer") having a coating weight per side of 50 mg/m$^2$ to 2,000 mg/m$^2$ obtained by applying a surface-treatment solution described later to a surface of the zinc or zinc alloy coated steel sheet, and drying the applied surface-treatment solution. The zinc or zinc alloy coated steel sheet disclosed herein is excellent in all of heat discoloration resistance, heat cracking resistance, planar part anti-corrosion property, corrosion resistance after alkali degreasing, blackening resistance, stack blackening resistance, anti-water stain property, solvent resistance, perspiration resistance, coating adhesion property, and storage stability.

<Surface-Treatment Solution for Zinc or Zinc Alloy Coated Steel Sheet>

The surface-treatment solution for a zinc or zinc alloy coated steel sheet according to the disclosure (hereinafter simply referred to as a "surface-treatment solution") may contain a glycidyl group-containing silane coupling agent (A), a tetraalkoxysilane (B), a zirconium carbonate compound (C), an anionic polyurethane resin (D) having a glass transition temperature (Tg) of 80° C. to 130° C., a vanadium compound (E), a molybdic acid compound (F), and water, and may optionally contain a sodium silicate (G) and a wax (H).

<Glycidyl Group-Containing Silane Coupling Agent (A)>

To the surface-treatment solution according to the disclosure, a glycidyl group-containing silane coupling agent (A) is added. The silane coupling agent (A) is not particularly limited as long as it contains a glycidyl group and a lower alkoxy group having 1 to 5, preferably 1 to 3 carbon atoms as hydrolyzable groups directly bonded to Si element. Examples thereof include, but are not limited to, 3-glycidoxypropyltrimethoxysilane, 3-glycidoxypropyltriethoxysilane, 3-glycidoxypropylmethyldimethoxy-silane, and 2-(3, 4-epoxycyclohexyl)ethyltriethoxysilane. Of these, 3-glycidoxypropyltrimethoxysilane and 3-glycidoxypropyltriethoxysilane are preferable from the perspectives of capability of generating more condensation points between the glycidyl group-containing silane coupling agents (A) and more condensation points with a tetraalkoxysilane (B) and a zirconium carbonate compound (C) described later, and of providing good barrier property after the layer formation.

In the glycidyl group-containing silane coupling agent (A), an alkoxy group is directly bonded to Si element in the compound, and it reacts with water in an aqueous solution to form a silanol group. This silanol group reacts with the surface of the zinc or zinc alloy coated steel sheet or undergoes a condensation reaction in a complex manner with components (B) and (C) described later.

It is necessary that a mass ratio ($A_S/X_S$) of the solid content mass ($A_S$) of the glycidyl group-containing silane coupling agent (A) to the total mass ($X_S$) be from 0.20 to 0.40, preferably from 0.24 to 0.37, and more preferably from 0.27 to 0.34. When the mass ratio is less than 0.20, the planar part anti-corrosion property and the corrosion resistance after alkali degreasing are inferior. When the mass ratio exceeds 0.40, the heat cracking resistance is inferior.

<Tetraalkoxysilane (B)>

When the component (A) is used alone, the heat cracking resistance is inferior. Thus, tetraalkoxysilane (B) is added to the surface-treatment solution disclosed herein. In the absence of the component (B), the organic functional group of the component (A) undergoes thermal oxidative decomposition in a heating atmosphere at 500° C. or higher, causing large cracks. On the other hand, when the component (B) is added in an appropriate amount, a dense layer with good barrier property can be obtained while suppressing the amount of the component (A) to such an extent that the heat cracking resistance is acceptable. Since the layer obtained from the component (A) and the component (B) is dense, cracks upon heating can also be refined, no cracks are visually observed, and excellent heat cracking resistance is obtained.

The tetraalkoxysilane (B) contains four lower alkoxyl groups as hydrolyzable groups directly bonded to Si element, and is not particularly limited as long as it can be represented by a general expression $Si(OR)_4$ (in the expression, R represents the same or different alkyl groups having carbon atoms of 1 to 5). Examples thereof may include: tetramethoxysilane; tetraethoxysilane; and tetrapropoxysilane, and at least one or more of these compounds may be used. Among these, tetraethoxysilane and tetramethoxysilane are preferable from the viewpoint of capability of generating more condensation points between tetraalkoxysilanes (B) and more condensation points with the component (A) or the below-described component (C), thereby providing good barrier property after the layer formation.

In the tetraalkoxysilane (B), an alkoxy group directly bonded to Si element in the compound, and the alkoxy group reacts with water in an aqueous solution to form a silanol group. This silanol group reacts with the surface of the zinc or zinc alloy coated steel sheet and undergoes a condensation reaction in a complex manner with the component (A) and the below-described component (C).

The mass ratio ($B_S/X_S$) of the solid content mass ($B_S$) of the tetraalkoxysilane (B) to the total mass ($X_S$) needs to be from 0.010 to 0.30, and is preferably from 0.03 to 0.23, and more preferably from 0.06 to 0.15. When the mass ratio is less than 0.010, the heat cracking resistance is lowered. When the mass ratio exceeds 0.30, the planar part anti-corrosion property and the corrosion resistance after alkali degreasing deteriorate.

The component (A) and the component (B) may be used alone, but it is preferable to add them to the surface-treatment solution after a condensation reaction of the component (A) with the component (B) to give a low condensate, in which case a even better barrier property can be obtained after the layer formation. This low condensate has a polysiloxane bond formed by a condensation reaction between the silanol groups of the components (A) and (B) as a main skeleton, and may be the one in which all of the terminal groups bonded to Si element are alkoxy groups or may be the one in which some of the groups directly bonded to Si element are alkoxy groups.

The condensation degree of the low condensate obtained by the condensation reaction of the component (A) with the component (B) is preferably 2 to 30, and more preferably 2 to 10. When the condensation degree is 30 or less, it is possible to stably use the component (A) and the component (B) without causing a white precipitate in the aqueous solution. The low condensate may be obtained by reacting the component (A), the component (B), and a chelating agent described later at a reaction temperature of 1° C. to 70° C. for about 10 minutes to 20 hours to perform autoclave treatment. Examples of the chelating agent include: hydroxycarboxylic acids such as malic acid, acetic acid, and tartaric acid; monocarboxylic acids; dicarboxylic acid such as oxalic acid, malonic acid, succinic acid, citric acid, and adipic acid or polycarboxylic acids such as tricarboxylic acid; and aminocarboxylic acids such as glycine, and at least one of these may be used.

The condensation state of the low condensate can be measured using gel permeation chromatography (GPC), NMR, and FT-IR described in JIS-K7252-4.

The chelating agent acting to stabilize this low condensate acts when the alkoxy group of the component (A) and the alkoxy group of the component (B) undergo hydrolysis reaction with water and a chelating agent. Although the reason for the stabilizing effect by the chelating agent is uncertain, this effect is considered as being obtained by the chelating agent properly coordinating to the silanol groups derived from the components (A) and (B) caused by the hydrolysis reaction. That is, a proper coordination action of the chelating agent to the silanol group suppresses excessive condensation of the components (A) and (B), and a surface-treatment solution excellent in storage stability can be obtained. Furthermore, stable layer quality can be obtained even after long-term storage of the surface-treatment solution.

The chelating agent is effective for securing corrosion resistance in addition to storage stability. Although the reason is uncertain, the chelating agent is considered to coordinate also with the vanadium compound (E) described later, and when the layer is exposed to a corrosive environment, the chelating agent coordinated to the vanadium compound (E) elutes with a vanadium compound (E), whereby the condensation of the components (A) and (B) losing the ligand in the layer progresses, thereby improving the barrier property of the layer and contributing to the corrosion resistance.

<Zirconium Carbonate Compound (C)>

A zirconium carbonate compound (C) is added to the surface-treatment solution disclosed herein. By using the components (A) and (B) in combination with the zirconium carbonate compound (C), it is possible to provide a dense layer that has good barrier property and that is excellent in heat cracking resistance, planar part anti-corrosion property, corrosion resistance after alkali degreasing, anti-water stain property, perspiration resistance, blackening resistance, and stack blackening resistance. The reason why the barrier property is enhanced is that the zirconium carbonate compound (C) has a hydroxyl group which is a condensation point with a silanol group. Further, since the zirconium carbonate compound (C) produces zirconium oxide and zirconium hydroxide when dried, the resulting layer is excellent in planar part anti-corrosion property, corrosion resistance after alkali degreasing, anti-water stain property, perspiration resistance, blackening resistance, and stack blackening resistance. The reason why the heat cracking resistance is high is considered to be that the volume shrinkage of zirconium oxide is low even when it is exposed to a heating atmosphere at 500° C., and furthermore, due to the thermal expansion of the coated layer, visually-unobservable micro cracks form in the zirconium oxide layer and disperse the stress such that no visually-observable cracks are formed, whereby excellent heat cracking resistance is obtained. Examples of the zirconium carbonate compound (C) include salts such as sodium, potassium, lithium, and ammonium of zirconium carbonate compounds, and at least one of these may be used. Among these, ammonium zirconium carbonate is preferable from the viewpoints of layer formability, anti-water stain property, and the like.

The mass ratio ($C_Z/X_S$) of the $ZrO_2$ equivalent mass ($C_Z$) in the zirconium carbonate compound (C) to the total mass ($X_S$) needs to be from 0.45 to 0.70, and is preferably from 0.48 to 0.67, and more preferably from 0.50 to 0.63. When the mass ratio is less than 0.45, the barrier property derived from the zirconium carbonate compound (D) is insufficient, and the planar part anti-corrosion property, the corrosion resistance after alkali degreasing, and the stack blackening resistance are lowered. Note that the blackening resistance is maintained. On the other hand, when the mass ratio exceeds 0.70, many hard components derived from the zirconium carbonate compound are contained, and good coating adhesion property can not be obtained.

The layer containing the above-described components (A) to (C) is usually hard and is excellent in barrier property, planar part anti-corrosion property, and corrosion resistance after alkali degreasing. This layer does not cause visually-observable cracks even upon heating above 500° C. due to the existence of the dense layer obtained from the thetetraalkoxysilane (B) and the zirconium carbonate compound (C), and is excellent in heat cracking resistance.

<Anionic Polyurethane Resin (D)>

An anionic polyurethane resin (D) having a glass transition temperature (Tg) of 80° C. to 130° C. is added to the surface-treatment solution disclosed herein in order to suppress cracks derived from inorganic components. As a result, it is possible to obtain a layer excellent in heat discoloration resistance, heat cracking resistance, planar part anti-corrosion property, blackening resistance, stack blackening resistance, anti-water stain property, solvent resistance, perspiration resistance, and coating adhesion property. The polyurethane resin has a high molecular weight and a urethane bond with high intermolecular cohesive force, and is thus dense and has good barrier property. Although the polyurethane resin itself has adhesion to the substrate, it exhibits even better barrier property when used in combination with the components (A) to (C). Accordingly, a layer having excellent performance as described above can be obtained.

Examples of a polyol which is the basic skeleton affecting the properties of the urethane resin include polyether-based polyols, polyester-based polyols, and polycarbonate-based polyols. Polyester-based polyols and polycarbonate-based polyols have polar groups, and can provide a tough layer by intermolecular interaction. Although polycarbonate-based polyols are expensive, they are excellent in mechanical strength. Since polyether-based polyols have no polar group, it is somewhat inferior in mechanical strength, yet is chemically stable in terms of, for example, hydrolysis resistance. The polyol of the component (D) used in the present disclosure is not particularly limited, yet from the viewpoints of the target properties of the present disclosure such as corrosion resistance after alkali degreasing and anti-water stain property, it is preferable to use a polyether-based polyol.

The weight average molecular weight of the component (D) is preferably about 10,000 to 500,000, and more preferably 50,000 to 300,000, when measured by the gel permeation chromatography as prescribed in JIS-K7252-4. Increasing the weight average molecular weight may improve the Tg and mechanical properties of the urethane resin, and hence the barrier property of the layer is improved, making it possible to improve the planar part anti-corrosion property, the corrosion resistance after alkali degreasing, the anti-water stain property, the solvent resistance, and the perspiration resistance.

The anionic polyurethane resin (D) is obtained by a general synthesis method using a polyether polyol (particularly diol) and polyisocyanate (particularly diisocyanate) as raw materials. Optionally, a polyamine (particularly diamine), a carboxylic acid having two or more (particularly preferably two) hydroxyl groups, and a reactive derivative of the carboxylic acid may be added as raw materials. Without limitation, a more specific synthesis may prepare a urethane prepolymer having isocyanate groups at both ends from a polyether diol and a diisocyanate and add a carboxylic acid having two hydroxyl groups or to obtain an anionic polyurethane resin by reacting the reactive derivative in the solvent to give a derivative having an isocyanate group at each end, then adding triethanolamine or the like as a counter cation, and subsequently adding to water to obtain an emulsion. Thereafter, chain extension may be carried out by further adding diamine, if necessary.

As the polyisocyanate used for producing the component (D), aliphatic, alicyclic, and aromatic polyisocyanates can be used, and any of these may be used. Specific examples thereof include tetramethylene diisocyanate, hexamethylene diisocyanate, lysine diisocyanate, hydrogenated xylylene diisocyanate, 1,4-cyclohexylene diisocyanate, 4,4'-dicyclohexyl methane diisocyanate, 2,4'-dicyclohexyl methane diisocyanate, isophorone diisocyanate, 3,3'-dimethoxy-4,4'-biphenylene diisocyanate, 1,5-naphthalene diisocyanate, 1,5-tetrahydronaphthalene diisocyanate, 2,4-tolylene diisocyanate, 2,6-tolylene diisocyanate, 4,4'-diphenylmethane diisocyanate, 2,4'-diphenylmethane diisocyanate, phenylene diisocyanate, xylylene diisocyanate, and tetramethylxylylene diisocyanate. Among these, an aliphatic or alicyclic polyisocyanate, such as tetramethylene diisocyanate, hexamethylene diisocyanate, lysine diisocyanate, hydrogenated xylene diisocyanate, 1,4-cyclohexylene diisocyanate, 4,4'-dicyclohexyl methane diisocyanate, 2,4'-dicyclohexyl methane diisocyanate, and isophorone diisocyanate, is preferably used since a layer excellent not only in solvent resistance, planar part anti-corrosion property, corrosion resistance after alkali degreasing, and the like, but also in heat discoloration resistance can be obtained.

Examples of the polyether polyols used for producing the component (D) include, in addition to the above-mentioned low molecular weight polyols such as 1,2-propanediol, 1,3-propanediol, trimethylolpropane, glycerin, polyglycerin, and pentaerythritol, bisphenol A, ethylene oxide and/or propylene oxide adducts to amine compounds such as ethylenediamine and the like, polytetramethylene ether glycol, and the like.

The carboxylic acid having two or more hydroxyl groups, preferably two hydroxyl groups, or a reactive derivative thereof used in the production of the component (D) is used for introducing an acidic group into the component (D) and for making the component (D) water dispersible. Examples of the carboxylic acid include dimethylol alkanoic acids such as dimethylolpropionic acid, dimethylolbutanoic acid, dimethylolpentanoic acid, and dimethylolhexanoic acid. Examples of the reactive derivative include an acid anhydride. In this way, by making the component (D) self-water dispersible and not using or minimizing the use of an emulsifying agent, it is possible to obtain a layer excellent in anti-water stain property.

In producing the component (D), polyamine, water, and the like are used. The polyamine, water, and the like are used to extend the chain of the prepared prepolymer. Examples of the polyamine to be used include hydrazine, ethylenediamine, propylenediamine, 1,6-hexanediamine, tetramethylenediamine, isophoronediamine, xylylenediamine, piperazine, 1,1'-bicyclohexane-4,4'-diamine, diphenylmethanediamine, ethyltolylenediamine, diethylenetriamine, dipropylenetriamine, triethylenetetramine, and tetraethylenepentamine, and these can be used alone or in combination of two or more.

In order to improve the stability of the resin at the time of synthesizing the component (D) and further enhance the layer formability when the ambient environment at the time of layer formation is in a low-temperature drying condition, it is preferable to incorporate a layer-forming aid at synthesis. Examples of the layer-forming aid include butyl cellosolve, N-methyl-2-pyrrolidone, butyl carbitol, and texanol; among these preferred is N-methyl-2-pyrrolidone.

The glass transition temperature (Tg) of the component (D) needs to be 80° C. to 130° C., and is preferably 85° C. to 125° C., and more preferably 90° C. to 120° C. The glass transition temperature is adjusted according to the molecular weight of the polyol to be used and the like. When the glass transition temperature (Tg) is lower than 80° C., the solvent resistance is inferior. This is because the cohesiveness among the components (D) when formed into a layer or the cohesiveness with the components (A) to (C) is insufficient and the barrier property of the layer deteriorates. On the other hand, when the glass transition temperature (Tg) exceeds 130° C., the layer becomes excessively hard, and excellent coating adhesion property can not be obtained. The glass transition temperature (Tg) of the component (E) can be measured by using a dynamic viscoelasticity measuring device (RSAG2 available from TA Instruments) to measure the dynamic viscoelasticity of a layer prepared as a measurement sample by drying at room temperature for 24 hours, then at 80° C. for 6 hours, and subsequently at 120° C. for 20 minutes, and to obtain the local maximum value of tan δ.

The mass ratio ($X_S/D_S$) of the total mass ($X_S$) of the components (A) to (C) to the solid content mass ($D_S$) of the anionic polyurethane resin (D) needs to be from 0.05 to 0.35, preferably from 0.10 to 0.32, and more preferably from 0.19 to 0.28. When the mass ratio is less than 0.05, the amount of the anionic polyurethane resin is large and the barrier property is insufficient. Accordingly, the planar part anti-corrosion property, the corrosion resistance after alkali degreasing, and the solvent resistance are lowered. On the other hand, when the mass ratio exceeds 0.35, the amount of the anionic polyurethane resin is small, and the heat discoloration resistance, heat cracking resistance, blackening resistance, stack blackening resistance, anti-water stain property, perspiration resistance, and coating adhesion property are inferior.

<Vanadium Compound (E)>

The vanadium compound (E) is added to the surface-treatment solution disclosed herein. The vanadium compound (E) exists in a uniformly-dispersed manner in the layer, yet it elutes appropriately in a corrosive environment and bonds with zinc ions eluted similarly in the corrosive environment to form a dense passive layer, thereby improving the planar part anti-corrosion property and the corrosion resistance after alkali degreasing. Examples of the vanadium compound (E) include ammonium metavanadate, sodium metavanadate, and vanadium acetylacetonate, and at least one of these may be used.

The mass ratio ($E_V/(X_S+D_S)$) of the V equivalent mass ($E_V$) in the vanadium compound (E) to the total mass ($X_S+D_S$) of the total mass ($X_S$) of the components (A) to (C) and the solid content mass ($D_S$) of the component (D) needs to be from 0.0010 to 0.015, preferably from 0.0017 to 0.011, and more preferably from 0.0023 to 0.007. When the mass ratio is less than 0.0010, the effect of forming a passive layer with zinc ions is insufficient, and the planar part anti-corrosion property and the corrosion resistance after alkali degreasing are lowered. On the other hand, when the mass ratio exceeds 0.015, it is not possible to obtain good blackening resistance, stack blackening resistance, anti-water stain property, perspiration resistance, and coating adhesion property. Further, since oxidative discoloration of vanadium appears during heating above 500° C., the heat discoloration resistance and heat cracking resistance are also lowered.

<Molybdic Acid Compound (F)>

A molybdic acid compound (F) is added to the surface-treatment solution disclosed herein in order to obtain excellent blackening resistance and stack blackening resistance. Examples of the molybdic acid compound include molybdic acid, ammonium molybdate, sodium molybdate, potassium molybdate, magnesium molybdate, and zinc molybdate, and it is preferable to use at least one selected from these in the present disclosure.

The black patina (blackening) phenomenon of a zinc or zinc alloy coated layer is believed to be caused by the formation of oxygen-deficient zinc oxide when the zinc or zinc alloy coated layer is exposed to a high-temperature and high-humidity atmosphere. Molybdenum is a second transition metal having various valences, and it is present as $MoO_2$ or $MoO_3$ in chemical combination with oxygen in the air. In the present disclosure, a molybdate such as $MoO_4^{2-}$ is used. It is considered that this molybdate is uniformly added to the layer and then reduced to a molybdenum oxide such as $MoO_3$ under a high-temperature and high-humidity atmosphere. It is considered that through this action, oxygen is appropriately supplied to the zinc on the surface of the zinc or zinc alloy coated layer, and formation of oxygen-deficient zinc oxide is suppressed. On the other hand, excessive addition of molybdate causes deterioration of the planar part anti-corrosion property and corrosion resistance after alkali degreasing.

The mass ratio ($F_M/(X_S+D_S)$) of the Mo equivalent mass ($F_M$) in the molybdic acid compound (F) to the total mass ($X_S+D_S$) of the total mass ($X_S$) of the components (A) to (C) and the solid content mass ($D_S$) of the component (D) needs to be from 0.0010 to 0.015, preferably from 0.0027 to 0.012, and more preferably from 0.0043 to 0.009. When the mass ratio is less than 0.0010, excellent blackening resistance and stack blackening resistance can not be obtained. When the mass ratio exceeds 0.015, good planar part anti-corrosion property and corrosion resistance after alkali degreasing can not be obtained.

<Sodium Silicate (G)>

In the surface-treatment solution disclosed herein, sodium silicate (G) may be added in place of some of the zirconium carbonates (C) in order to obtain even better heat cracking resistance. The amount of zirconium carbonates (C) can be reduced by increasing the amount of the sodium silicate (G). The sodium contained in the sodium silicate (G) bonds with an oxygen atom of a $SiO_4$ tetrahedron separated from the $SiO_4$ bonding network by heat. Therefore, recombination of the $SiO_4$ bonding network is prevented. By this action, the component (G) imparts fluidity to the silicate glass, and the softening temperature of the silicate glass is lowered from at or above 1,700° C. to 500° C. to 700° C. In the present disclosure, it is considered that by utilizing this effect, when a layer including the components (A) to (C) that is hard and has a low thermal expansion coefficient is heated to 500° C.

or higher, flowability is imparted to the layer, and excellent heat resistant cracking resistance is obtained.

The sodium silicate (G) used in the present disclosure includes $SiO_2$ and $Na_2O$, and the molar ratio thereof is not particularly limited as long as $SiO_2/Na_2O$ is from 4 to 1. Examples thereof include No. 2 sodium silicate and No. 3 sodium silicate, and one or more of these may be used. A more preferable molar ratio is $SiO_2/Na_2O$ of from 4 to 2. When $SiO_2/Na_2O$ exceeds 4, the effect for heat cracking resistance is insufficient. When $SiO_2/Na_2O$ is less than 1, although the effect on heat cracking resistance is saturated, immobilization of the sodium silicate (G) into the layer becomes difficult, and the blackening resistance can be maintained. However, the stack blackening resistance, which is evaluated in a more severe environment, is inferior.

From the viewpoint of not lowering the stack blackening resistance, with regard to the amount of the sodium silicate (G), the mass ratio ($G_S/(X_S\ G_S)$) of the solid content mass ($G_S$) of the sodium silicate (G) to the total mass ($X_S+G_S$) of the total mass ($X_S$) of components (A) to (C) and the solid mass ($G_S$) of the sodium silicate (G) is less than 0.05 (inclusive of 0.00, i.e., including the case where it is not added). It is more preferably 0.047 or less, and still more preferably 0.042 or less. When the mass ratio is 0.05 or more, the stack blackening resistance is inferior. On the other hand, the lower limit is preferably set to 0.00, yet it may be 0.001 or more, and more preferably 0.005 or more, in expectation of further improving heat cracking resistance.

<Wax (H)>

A wax (H) may be added to the surface-treatment solution disclosed herein in order to improve lubricity. The wax (H) is not particularly limited as long as it is compatible with the solution. Examples thereof include polyolefin wax such as polyethylene, montan wax, paraffin wax, microcrystalline wax, carnauba wax, lanolin-based wax, silicon-based wax, and fluorine-based wax, and at least one of these may be suitably used. Examples of the polyolefin wax include polyethylene wax, oxidized polyethylene wax, and polypropylene wax, and at least one of these may be used.

The mass ratio ($H_S/(X_S+D_S)$) of the solid content mass ($H_S$) of the wax (H) to the total mass ($X_S+D_S$) is preferably from 0.002 to 0.10, and more preferably from 0.01 to 0.08. When the mass ratio is 0.002 or more, a sufficient lubricity-improving effect can be obtained. On the other hand, when the mass ratio is 0.10 or less, there is no concern for excessively high lubricity leading to coil collapse in the coiling process during coil production. Also, there is no concern that the planar part anti-corrosion property, the corrosion resistance after alkali degreasing, or the coating adhesion property may deteriorate.

<pH: 8.0 to 10.0>

The surface-treatment solution disclosed herein is obtained by mixing the above-mentioned components in water such as deionized water or distilled water. The solid content ratio of the surface-treatment solution may be appropriately selected, yet it is preferably 10% to 20%. The pH of the surface-treatment solution needs to be adjusted to 8.0 to 10.0, and preferably 8.5 to 9.5. When the pH is less than 8.0 or more than 10.0, the storage stability of the surface-treatment solution decreases. Further, when the pH exceeds 10.0, the etching of the zinc or zinc alloy coated layer becomes excessive and the planar part anti-corrosion property and the corrosion resistance after alkali degreasing are lowered. When pH is adjusted, ammonia or a salt thereof and any one or more of the above-mentioned chelating agents may be appropriately used.

Further, if required, an additive may be added to the surface-treatment solution, such as an alcohol, a ketone, a cellosolve, an amine-based water-soluble solvent, a defoamer, a fungicidal/antifungal agent, a coloring agent, a wettability improving agent for uniform coating, a resin, a surfactant, or the like. However, it is important that these additives are added only to such an extent that the addition will not adversely affect the quality achievable by the present disclosure. The maximum amount is preferably less than 5 mass % with respect to the total solid content of the surface-treatment solution.

<Method of Producing a Zinc or Zinc Alloy Coated Steel Sheet with a Surface-Coating Layer>

The method of producing a zinc or zinc alloy coated steel sheet with a surface-coating layer according to the present disclosure comprises: applying the above-described surface-treatment solution to a surface of a zinc or zinc alloy coated steel sheet; and subsequently drying the applied surface-treatment solution to form a surface-coating layer having a coating weight of 50 mg/m$^2$ to 2,000 mg/m$^2$. The conditions and methods for forming the layer will be described in detail below.

The coating weight of the surface-coating layer after heating and drying is 50 mg/m$^2$ to 2,000 mg/m$^2$ per side, and preferably 500 mg/m$^2$ to 1,500 mg/m$^2$ per side. When the coating weight is less than 50 mg/m$^2$, the barrier property becomes insufficient, and the planar part anti-corrosion property, corrosion resistance after alkali degreasing, blackening resistance, anti-water stain property, and perspiration resistance can not be ensured. On the other hand, when the coating weight exceeds 2,000 mg/m$^2$, the layer is thick, and the heat discoloration resistance and heat cracking resistance are inferior.

Before applying the surface-treatment solution to the zinc or zinc alloy coated steel sheet, the zinc or zinc alloy coated steel sheet may optionally be subjected to a pre-treatment for removing oil and stains on its surface. Zinc or zinc alloy coated steel sheets are often coated with anti-rust oil to prevent them from rusting. Even when not coated with anti-rust oil, such steel sheets still have oil or stains which have adhered during operation. Through the above-mentioned pre-treatment, the surface of the zinc or zinc alloy coated layer is cleaned and becomes easy to be wetted uniformly. In the case where the surface of the zinc or zinc alloy coated steel sheet is free of oil and stains and can be uniformly wetted with the surface-treatment solution, such pre-treatment is not necessary. The method of pretreatment is not particularly limited, and examples thereof include hot water rinsing, organic solvent washing, and alkali degreasing washing.

As a method of applying the surface-treatment solution to a surface of a zinc or zinc alloy coated steel sheet, an optimum method may be selected as appropriate depending on the shape of the zinc or zinc alloy coated steel sheet to be processed. Examples thereof include roll coating, bar coating, dip coating, and spray coating. After the application, an air knife or squeezing rolls may be used to adjust the coating weight or to ensure the uniformity of appearance or layer thickness.

As a means for heating and drying the zinc or zinc alloy coated steel sheet after the application of the surface-treatment solution, a dryer, a hot air oven, a high frequency induction heater, or a drying furnace such as an infrared oven may be used.

Preferably, $T_S$ is 15° C. to 55° C., $T_L$ is 10° C. to 40° C., and $\Delta T$ is 5° C. to 40° C., where $T_S$ and $T_L$ represent a temperature of the zinc or zinc alloy coated steel sheet and a temperature of the surface-treatment solution in the applying of the surface-treatment solution, respectively, and ΔT represents $T_S-T_L$. It is also preferable that the drying is performed in two steps including a preliminary drying step of drying the applied surface-treatment solution in the atmosphere for a time t seconds, and a heating and drying step of subsequently heating and drying the applied surface-treatment solution in a drying furnace, wherein ΔT/t is 1° C./s to 60° C./s.

$T_L$ is preferably around room temperature, that is, from 10° C. to 40° C. When the $T_L$ is less than 10° C., the fluidity of the surface-treatment solution decreases, and when it exceeds 40° C., the storage stability of the surface-treatment solution deteriorates. $T_S$ is preferably set to 15° C. to 55° C. in order to ensure ΔT for obtaining a two-phase separation layer in which a Zr-containing phase described later has a desired volume fraction.

In this embodiment, firstly, it is important to provide a temperature difference ΔT between $T_S$ and $T_L$ by at least a predetermined temperature, and secondly, to determine a time t (sec) in the preliminary drying step in relation to the temperature difference ΔT. In this way, moisture in the surface-treatment solution layer formed on the surface of the steel sheet can be gradually vaporized. That is, in the surface-treatment solution layer formed on the surface of the steel sheet, before the water vaporizes, Si begins a condensation reaction with moisture together with Zr, and a desired surface-coating layer can be obtained. When ΔT is less than 5° C., moisture in the surface-treatment solution layer does not vaporize, making it impossible to obtain a two-phase separation layer having a Zr-containing phase described later in a desired volume fraction. When ΔT is over 40° C., moisture in the surface-treatment solution layer begins to vaporize before the above condensation reaction starts, making it impossible to secure a predetermined amount of a phase (a Zr-free phase described later) made of a resin component constituting the skeleton of the layer. When ΔT/t is less than 1° C./s, the above condensation reaction becomes excessive and a two-phase separation layer having a volume fraction as described below can not be obtained. In the case of ΔT/t exceeding 60° C./s, the condensation reaction becomes insufficient, and it is impossible to secure a predetermined amount of a phase (a Zr-free phase described later) made of a resin component constituting the skeleton of the layer.

The subsequent heating and drying step can be carried out according to the conventional method, and is not particularly limited, yet the peak metal temperature (PMT) is preferably 60° C. to 200° C., and more preferably 80° C. to 180° C. When the PMT is 200° C. or lower, the layer is less prone to cracks and the layer components hardly undergo thermal decomposition, and various performances required by the present disclosure are not deteriorated. On the other hand, if the PMT is 60° C. or higher, the bonding between the components of the surface-coating layer is sufficiently obtained, various performances required by the present disclosure do not deteriorate. Regarding the heating time, it is preferably 0.1 seconds to 60 seconds, and particularly preferably 1 second to 30 seconds from the viewpoint of productivity and the like, while optimal conditions are selected as appropriate depending on the conditions such as the composition of the zinc or zinc alloy coated steel sheet to be used, the process and configuration of the production line, and so on.

<Form of Surface-Coating Layer>

The surface-coating layer thus formed on the surface of the zinc or zinc alloy coated steel sheet is separated into a Zr-containing phase and a Zr-free phase by Si undergoing a condensation reaction with Zr during the heating and drying. As used herein, "Zr-free phase" means a phase having a Zr content of less than 3 mass % with respect to the entire constituent elements.

The Zr-containing phase refers to a phase that is composed mainly of inorganic materials such as oxides of Si, Zr, and V. The Zr-free phase refers to a phase that constitutes a basic skeleton for forming the surface-coating layer, that is composed mainly of C and O, and that further contains resin components including Si. Since Si is concentrated in the Zr-containing phase, the Si concentration of the Zr-containing phase is higher than that of the Zr-free phase.

Si in the surface-coating layer may enhance the bondability between Si, the bondability between the Zr-containing phase and the Zr-free phase, and the bondability between the layer and the surface of the coated layer, thereby improving the corrosion resistance.

Zr in the surface-coating layer is an important element for forming a phase made of an inorganic material including Zr. By distributing the Zr-containing phase in the surface-coating layer, it is possible to enhance the bondability between the Zr-containing phase and the Zr-free phase and to form a dense layer with good barrier property. To obtain this effect, the Zr-containing phase has a volume fraction of preferably 5% to 40%, and more preferably 5% to 30%, with respect to the entire surface-coating layer. When the volume fraction of the Zr-containing phase is less than 5%, elution of V becomes insufficient, and the corrosion resistance is no longer improved.

When the volume fraction of the Zr-containing phase exceeds 40%, the barrier property of the layer imparted by organic components is deteriorated, and the corrosion resistance is no longer improved.

When the ratio between the concentrations of Zr and Si in the Zr-containing phase is expressed as Zr/(Si+Zr) in terms of mass ratio, the ratio is preferably 0.50 or more and 0.95 or less.

When coexisting with the Zr-containing phase, V in the surface-coating layer adequately elutes under a corrosive environment and bonds with zinc ions eluted from the coating surface to form a dense passive layer, thereby improving corrosion resistance. To obtain this effect, the V content in the Zr-containing phase is preferably 0.003 to 0.1 when expressed as V/(Si+Zr) in terms of mass ratio.

The volume fraction of the Zr-containing phase can be evaluated by observing a surface or a cross section of the layer with an electron microscope. A scanning electron microscope (SEM) can be used for the observation. In recent SEMs, there are various types of secondary electron detector and backscattered electron detector depending on manufacturer and model, and it is reported that different information can be obtained depending on viewing conditions. Therefore, to observe the layer surface, appropriate observation conditions may be selected depending on the apparatus to be used every time. However, when the accelerating voltage varies greatly, the information depth varies and the evaluation results may vary accordingly. It is thus preferable to evaluate the acceleration voltage in the range of 0.5 kV to 3 kV. For observation of the cross section of the layer, it is suitable to observe a cross section of the layer processed with the focused ion beam (FIB) under an SEM, or to observe a sample processed to flakes with FIB under a transmission electron microscope (TEM) or a scanning transmission electron microscope (STEM). The Zr-containing phase and the Zr-free phase can be clearly distinguished by the contrast difference in electron microscope images. In particular, when evaluating by SEM observation of a surface of the layer, a secondary electron image observation is carried out using an Everhart-Thornley type detector as a general secondary electron detector with a low accelerating voltage of about 0.5 kV to 3 kV, where a phase made of an inorganic material (a Zr-containing phase) appears bright, while a phase made of a resin component (a Zr-free phase) dark.

Accordingly, it is possible to set the observation condition in which the contrast difference appears clearly, binarize the observed electron microscope image, calculate the area ratio of the Zr-containing phase, and consider the result as the volume fraction. Since there are various methods of binarization and numerical values may vary with the selected threshold, it is important to determine the threshold so as not to largely deviate from the distinction between the bright part and the dark part discriminated from the original image. For example, when a secondary electron image is established using an Everhart-Thornley type detector at an accelerating voltage of 1 kV to 2 kV, it is effective to binarize the image using a maximum entropy method. At this time, the observation magnification is preferably about 10,000 time to 30,000 times. In addition, at this time, it is conceivable that there are variations depending on the observation location, it is preferable to acquire images of at least 5 fields of view or more for each sample and use the average as the evaluation value. As for the observation image, by performing smoothing to remove noise, more accurate evaluation can be made. However, if the smoothing is excessive, the resolution of the image deteriorates, which may affect the evaluation results. It is thus preferable to set the operator size to about 10 nm at the maximum. In addition, in the microscope observation, in order to discriminate between a Zr-containing phase and a Zr-free phase for each target region, element analysis by energy dispersive spectroscopy (EDS) can be used for the cross-sectional observation under TEM or STEM. By elemental analysis in each phase, it can be determined whether Zr is contained or not in each phase.

Advantageous effects of the present disclosure will now be described with reference to examples and comparative examples. The disclosed examples are provided by way of illustration only and not intended to be limiting of the present disclosure.

EXAMPLES

Example 1

(1) Sample Sheet

The below-described zinc or zinc alloy coated steel sheets were used as sample sheets. Note that a zinc or zinc alloy coated layer was formed on both surfaces of each steel sheet and the coating weight in Table 1 indicates the coating weight per side of a zinc or zinc alloy coated layer. The surface area ratio of the Zn—Al—Mg-based eutectic alloy determined by the below-described method is also listed in Table 1. SEM observation is performed at random sites on the surface of the coated layer at 100 times magnification. Then, Mg mapping is carried out by EDS in the same field of view. The result is analyzed to make binarization. From this binary image, the area ratio of the Zn—Al—Mg-based eutectic alloy is calculated. Similar evaluation is carried out in arbitrary 8 fields of view, and finally the result of arithmetically averaging the area ratios of all fields of view is taken as the surface area ratio of the Zn—Al—Mg-based eutectic alloy.

TABLE 1

| ID | Zinc or zinc alloy coated steel sheet | Thickness | Coating weight per side | Surface area ratio of Zn—Al—Mg-based eutectic alloy |
|---|---|---|---|---|
| (I) | hot-dip galvanized steel sheet | 0.8 mm | 60 g/m$^2$ | — |
| (II) | hot-dip Zn-5 mass % Al-0.6 mass % Mg alloy coated steel sheet | 0.8 mm | 90 g/m$^2$ | 22 |
| (III) | hot-dip Zn-5 mass % Al-0.6 mass % Mg-0.04 mass % Ni alloy coated steel sheet | 0.8 mm | 90 g/m$^2$ | 22 |
| (IV) | hot-dip Zn-4.8 mass % Al-0.9 mass % Mg-0.03 mass % Ni alloy coated steel sheet | 0.8 mm | 80 g/m$^2$ | 18 |
| (V) | hot-dip Zn-5 mass % Al-0.7 mass % Mg-0.04 mass % Ni alloy coated steel sheet | 0.8 mm | 90 g/m$^2$ | 23 |

(2) Pre-Treatment (Cleaning)

The surface of each sample sheet was treated using PALCLEAN N364 S manufactured by Nihon Parkerizing Co., Ltd., to remove oil and stains from the surface. The surface of the sample sheet was then washed with tap water to make sure that the surface was 100% wettable with water, and pure water (deionized water) was poured over the surface. The sample sheet was dried in an oven of 100° C. atmosphere to remove moisture.

(3) Preparation of Surface-Treatment Solution

The components (A) to (H) listed in Table 2 were mixed in water at the mass ratios in Table 2 to obtain surface-treatment solutions having a solid content of 15 mass %.

The compounds in Table 2 are as follows.

<Glycidyl Group-Containing Silane Coupling Agent (A)>

A1: 3-glycidoxypropyltriethoxysilane

A2: 3-glycidoxypropyltrimethoxysilane

<Tetraalkoxysilane (B)>

B1: tetramethoxysilane

B2: tetraethoxysilane

<Zirconium Carbonate Compound (C)>

C1: Potassium zirconium carbonate ($ZrO_2$: 20.0 mass %)

C2: Zirconium ammonium carbonate ($ZrO_2$: 20.0 mass %)

<Anionic Polyurethane Resin (D)>

Production Method 1 (Anionic Polyurethane Resin D1)

To a reactor were added 100 parts by mass of a polyether polyol having a number average molecular weight of 5,000 obtained from polyethylene glycol and polypropylene glycol, 5 parts by mass of 2,2-dimethyl-1,3-propanediol, 100 parts by mass of 4,4-dicyclohexylmethane diisocyanate, 20 parts by mass of 2,2-dimethylolpropionic acid, and 120 parts by mass of N-methyl-2-pyrrolidone to obtain a urethane prepolymer having a free isocyanate group content of 5% with respect to the nonvolatile content. Then, 16 parts by mass of tetramethylene diamine and 10 parts by mass of triethylamine were added to 500 parts by mass of deionized water, and while stirring with a homomixer, and the urethane prepolymer was added and emulsified and dispersed.

Finally, deionized water was added to obtain a water-dispersible polyurethane resin having a solid content of 25 mass %. The glass transition temperature (Tg) of the obtained polyurethane resin (D1) was measured using a dynamic viscoelasticity measuring device and was found to be 40° C.

Production Method 2 (Anionic Polyurethane Resin D2)

A water-dispersible urethane resin having a solid content of 25 mass % was obtained in the same manner as in Production Method 1, except that in place of 100 parts by mass of a polyether polyol having a number average molecular weight of 5,000 obtained from polyethylene glycol and polypropylene glycol, 100 parts by mass of a polyester polyol having a number average molecular weight of 2,220 obtained from 1,6-hexanediol and adipic acid was used in the reactor. The glass transition temperature (Tg) of the obtained polyurethane resin (D2) was measured using the dynamic viscoelasticity measuring device and was found to be 70° C.

Production Method 3 (Anionic Polyurethane Resin D3)

A water-dispersible urethane resin having a solid content of 25 mass % was obtained in the same manner as in Production Method 1, except that in place of 100 parts by mass of a polyether polyol having a number average molecular weight of 5,000 obtained from polyethylene glycol and polypropylene glycol, 100 parts by mass of a polyester polyol having a number average molecular weight of 2,060 obtained from 1,6-hexanediol and adipic acid was used in the reactor. The glass transition temperature (Tg) of the obtained polyurethane resin (D3) was measured using the dynamic viscoelasticity measuring device and was found to be 80° C.

Production Method 4 (Anionic Polyurethane Resin D4)

A water-dispersible urethane resin having a solid content of 25 mass % was obtained in the same manner as in Production Method 1, except that instead of 100 parts by mass of a polyether polyol having a number average molecular weight of 5,000 obtained from polyethylene glycol and polypropylene glycol, 100 parts by mass of a polyether polyol having a number average molecular weight of 1,900 obtained from polyethylene glycol and polypropylene glycol was used in the reactor. The glass transition temperature (Tg) of the obtained polyurethane resin (D4) was measured using the dynamic viscoelasticity measuring device and was found to be 85° C.

Production Method 5 (Anionic Polyurethane Resin D5)

A water-dispersible urethane resin having a solid content of 25 mass % was obtained in the same manner as in Production Method 1, except that in place of 100 parts by mass of a polyether polyol having a number average molecular weight of 5,000 obtained from polyethylene glycol and polypropylene glycol, 100 parts by mass of a polyether polyol having a number average molecular weight of 1,740 obtained from polyethylene glycol and polypropylene glycol was used in the reactor. The glass transition temperature (Tg) of the obtained polyurethane resin (D5) was measured using the dynamic viscoelasticity measuring device and was found to be 90° C.

Production Method 6 (Anionic Polyurethane Resin D6)

A water-dispersible urethane resin having a solid content of 25 mass % was obtained in the same manner as in Production Method 1, except that in place of 100 parts by mass of a polyether polyol having a number average molecular weight of 5,000 obtained from polyethylene glycol and polypropylene glycol, 100 parts by mass of a polyether polyol having a number average molecular weight of 1,560 obtained from polyethylene glycol and polypropylene glycol was used in the reactor. The glass transition temperature (Tg) of the obtained polyurethane resin (D6) was measured using the dynamic viscoelasticity measuring device and was found to be 105° C.

Production Method 7 (Anionic Polyurethane Resin D7)

A water-dispersible urethane resin having a solid content of 25 mass % was obtained in the same manner as in Production Method 1, except that in place of 100 parts by mass of a polyether polyol having a number average molecular weight of 5,000 obtained from polyethylene glycol and polypropylene glycol, 100 parts by mass of a polyester polyol having a number average molecular weight of 1,320 obtained from 1,6-hexanediol and adipic acid was used in the reactor. The glass transition temperature (Tg) of the obtained polyurethane resin (D7) was measured using the dynamic viscoelasticity measuring device and was found to be 120° C.

Production Method 8 (Anionic Polyurethane Resin D8)

A water dispersible urethane resin having a solid content of 25 mass % was obtained in the same manner as in Production Method 1, except that in place of 100 parts by mass of a polyether polyol having a number average molecular weight of 5,000 obtained from polyethylene glycol and polypropylene glycol, 100 parts by mass of a polyester polyol having a number average molecular weight of 1,240 obtained from 1,6-hexanediol and adipic acid was used in the reactor. The glass transition temperature (Tg) of the obtained polyurethane resin (D8) was measured using the dynamic viscoelasticity measuring device and was found to be 125° C.

Production Method 9 (Anionic Polyurethane Resin D9)

A water-dispersible urethane resin having a solid content of 25 mass % was obtained in the same manner as in Production Method 1, except that in place of 100 parts by mass of a polyether polyol having a number average molecular weight of 5,000 obtained from polyethylene glycol and polypropylene glycol, 100 parts by mass of a polyester polyol having a number average molecular weight of 1,160 obtained from 1,6-hexanediol and adipic acid was used in the reactor. The glass transition temperature (Tg) of the obtained polyurethane resin (D9) was measured using the dynamic viscoelasticity measuring device and was found to be 130° C.

Production Method 10 (Anionic Polyurethane Resin D10)

A water-dispersible urethane resin having a solid content of 25 mass % was obtained in the same manner as in Production Method 1, except that in place of 100 parts by mass of a polyether polyol having a number average molecular weight of 5,000 obtained from polyethylene glycol and polypropylene glycol, 100 parts by mass of a polyester polyol having a number average molecular weight of 1,000 obtained from 1,6-hexanediol and adipic acid was used in the reactor. The glass transition temperature (Tg) of the obtained polyurethane resin (D10) was measured using the dynamic viscoelasticity measuring device and was found to be 140° C.

<Vanadium Compound (E)>

E1: ammonium metavanadate (V: 43.5 mass %)

E2: metavanadyl acetylacetonate (V: 19.2 mass %)

<Molybdic Acid Compound (F)>

F1: ammonium molybdate (Mo: 54.4 mass %)

F2: sodium molybdate (Mo: 43.8 mass %)

<Sodium Silicate (G)>

G1: No. 3 sodium silicate (solid content: 38.5 mass %)

G2: No. 2 sodium silicate (solid content: 40.6 mass %)

<Wax (H)>

H1: polyethylene wax (Chemipearl® W900 manufactured by Mitsui Chemicals, Inc., solid content: 40.0 mass %; Chemipearl is a registered trademark in Japan, other countries, or both)

H2: microcrystalline wax (Nopco® 1245-M-SN manufactured by San Nopco Limited, solid content: 46.0 mass %; Nopco is a registered trademark in Japan, other countries, or both)

(4) Treatment Method

Each surface-treatment solution listed in Table 2 was applied to the corresponding sample sheet after pretreatment listed in the "Steel Sheet" column in Table 3 with a bar coater, then directly placed in an oven without being washed with water, and dried at a peak metal temperature (PMT) in the "PMT" column to form a surface-coating layer having a coating weight (per side) in Table 3 on one side of the sample sheet. The coating weight was determined by quantitatively determining the Zr of the compounded zirconium carbonate compound (C) by a fluorescent X-ray analyzer and converting it from the Zr coating weight to the layer coating weight.

(5) Evaluation Test Method

The results of evaluations of the following (5-1) to (5-12) on each obtained zinc or zinc alloy coated steel sheet with a surface-coating layer (hereinafter simply referred to as a "sample") are also listed in Table 3. Evaluation criteria C and D are not preferable due to insufficient performance.

(5-1) Heat Discoloration Resistance

Evaluation was made for each sample by: heating the sample in an IR image furnace to a sheet temperature of 500° C. in 30 seconds; retaining the sample at 500° C. for 5 minutes; taking the sample out of the IR image furnace and leaving the sample to allow it to be naturally cooled to the room temperature; and visually observing the surface appearance of the sample when it was cooled. The evaluation criteria are as follows.

(Evaluation Criteria)

A: no color change

B: very slightly yellowish

B-: slightly yellowish

B=: very slightly brownish

B≡: slightly brownish

C: discolored to brown

D: discolored to dark brown (5-2) Heat Cracking Resistance

Evaluation was made for each sample by: heating the sample in an IR image furnace to a sheet temperature of 500° C. in 30 seconds; retaining the sample at 500° C. for 5 minutes; taking the sample out of the IR image furnace and leaving the sample to allow it to be naturally cooled to the room temperature; and visually observing the surface appearance of the sample when it was cooled. Visually-unobservable cracks were observed with an optical microscope at 1,000 times magnification. The evaluation criteria are as follows.

(Evaluation Criteria)

A: no cracks occurred

B: few visually-unobservable cracks occurred

B-: no visually-observable cracks, but visually-unobservable cracks occurred

B=: very few cracks occurred

B≡: few cracks occurred

C: narrow cracks occurred on the entire surface

D: narrow and broad cracks spread across the entire surface (5-3) Planar Part Anti-Corrosion Property Each sample was subjected to a salt spray test (SST) according to JIS-Z-2371-2000, in a planar state without being pressed. The planar part anti-corrosion property was evaluated based on the white rust area ratio after 240 hours. The evaluation criteria are as follows.

(Evaluation Criteria)

A: white rust area ratio being less than 5%

B: white rust area ratio being 5% or more and less than 10%

B-: white rust area ratio being 10% or more and less than 25%

C: white rust area ratio being 25% or more and less than 50%

D: white rust area ratio being 50% or more and 100% or less (5-4) Corrosion Resistance after Alkali Degreasing Evaluation was made for each sample by: dissolving an alkali degreasing agent FC-E6406 (manufactured by Nihon Parkerizing Co., Ltd.) in pure water at concentration of 20 g/L and heating the solution to 60° C.; immersing the sample in the alkali solution thus prepared for two minutes, then taking the sample out of the solution, washing with water, and drying the sample; and subjecting the sample to a salt spray test (JIS-Z-2371-2000) to determine a white rust generation state 120 hours after the spray according to the white rust area ratio. The evaluation criteria are the same as in (5-3) above.

(5-5) Blackening Resistance

Evaluation was made for each sample by: measuring the brightness (L-value) of the sample before the test; leaving the sample for 24 hours in a thermo-hygrostat controlled in an atmosphere at a temperature of 80° C. and a relative humidity of 98%; then measuring the brightness (L-value) of the sample; and calculating the change in brightness (L-value): $\Delta L$=(the L-value after the test)−(the L-value before the test). The evaluation criteria are as follows. The L value was measured by SCI mode (specularly reflected light included) using SR 2000 manufactured by Nippon Denshoku Industries Co., Ltd.

(Evaluation Criteria)

A: $-6<\Delta L$, and with uniform appearance without unevenness

B: $-10<\Delta L\leq-6$, and with uniform appearance without unevenness

B-: $-14<\Delta L\leq-10$, and with uniform appearance without unevenness

C: $-14<\Delta L\leq-10$, and with fine black spots

D: $\Delta L\leq-14$, or with uneven appearance (5-6) Stack Blackening Resistance Target surfaces of two samples having the same layer were overlapped with each other and tighten together at a torque of 20 kgf, and left standing for 4 weeks in a thermo-hygrostat controlled in an atmosphere at a temperature of 50° C. and a relative humidity of 98%, and its surface appearance was visually observed. The evaluation criteria are as follows.

(Evaluation Criteria)

A: no discoloration, and with uniform appearance without unevenness

B: very slightly discolored to black, and with uniform appearance without unevenness B-: slightly discolored to black, and with uniform appearance without unevenness B=: very slightly discolored to black, and with fine black spots B≡: slightly discolored to black, and with fine black spots C: discolored to black, and with fine black spots D: discolored to black, and with uneven appearance (5-7) Anti-Water Stain Property The anti-water stain property was evaluated for each sample by: dropping 100 μL deionized water onto the sample surface in a planar state without being pressed; placing the sample in a hot-air oven at a furnace temperature of 100° C. for 10 minutes; and visually observing the water drop trace after removing the sample from the oven. The evaluation criteria are as follows.

(Evaluation Criteria)

A: no water drop boundary being observed from any angle

B: water drop boundary being slightly observed depending on angle

B⁻: water drop boundary being slightly observed from any angle

C: water drop boundary being clearly observed from any angle

D: water drop boundary being clearly observed beyond dropping range (5-8) Solvent Resistance Evaluation was made for each sample by: pressing a piece of gauze soaked with ethanol against the sample surface at a load of 4.90 N (500 gf); rubbing the sample surface with the gauze ten times reciprocally at the same load; and visually evaluating the scars resulted from the rubbing. The evaluation criteria are as follows.

(Evaluation Criteria)

A: no scars

B: scars not observed when viewed from the top, but clearly observed when viewed diagonally B-: scars slightly observed when viewed from the top C: scars clearly observed when viewed from the top D: layer peeled off (5-9) Perspiration Resistance For each sample, 10 μL of artificial perspiration conforming to JIS-B7001-1995 was dropped on the sample surface, and a silicone rubber stopper was pressed against the dropping portion to prepare a site contaminated to a certain area with artificial perspiration. Each test piece thus prepared was allowed to stand for 4 hours in a thermo-hygrostat controlled in an atmosphere at a temperature of 40° C. and a relative humidity of 80%, and the appearance change of the contaminated site was evaluated. The evaluation criteria are as follows.

(Evaluation Criteria)

A: no color change

B: very slight discoloration

B-: slight discoloration

C: slightly discolored to black

D: clearly discolored to black (5-10) Coating Adhesion Property

Delicon® #700 (manufactured by Dai Nippon Toryo Co., Ltd.; Delicon is a registered trademark in Japan, other countries, or both), which is a melamine alkyd-based paint, was applied to each sample and baked at 130° C. for 30 minutes to form a coating layer having a thickness of 30 μm. Subsequently, it was immersed in boiling water for 2 hours, and immediately cuts were made to reach the steel substrate in a grid form (10 by 10, 1 mm interval). Further, an Erichsen extruder was used to apply extrusion processing of 5 mm such that the cuts were on the outer (front) side, and the peeling area of the coating layer was measured by applying and peeling an adhesive tape. The evaluation criteria are as follows. Note that the Erichsen extrusion conditions were in accordance with JIS Z-2247-2006, with a punch diameter of 20 mm, a die diameter of 27 mm, and a drawing width of 27 mm.

(Evaluation Criteria)

A: no peeling

B: peeled area ratio being less than 3%

B-: peeled area ratio being 3% or more and less than 10%

C: peeled area ratio being 10% or more and less than 30%

D: peeled area ratio being 30% or more (5-11) Lubricity

Evaluation was made for each sample by: cutting a disc-shaped test piece with a diameter of 100 mm out of the sample; molding the test piece into a cup-like shape under a set of conditions including a punch diameter of 50 mm, a die diameter of 51.91 mm, and a blank holding force of 1 t; visually analyzing the appearance of the drawing-processed surface of the test piece thus molded (i.e., the appearance of the external surface of the side of the cup); and evaluating the severity of scars and the degree of blackening of the surface. The evaluation criteria are as follows.

(Evaluation Criteria)

A: substantially no change over the entire surface, with uniform appearance

B: minor scars and blackening, with clearly non-uniform appearance

B-: local scars and blackening, with clearly non-uniform appearance

C: severe scars and blackening mainly at corners

D: molding failed due to cracking (5-12) Storage Stability

Each of the surface-treatment solutions listed in Table 2 was stored in a constant temperature bath at 40° C. for 30 days. Then, each surface-treatment solution was removed from the bath and its appearance was visually examined and evaluated. The evaluation criteria are as follows.

(Evaluation Criteria)

A: no change

B: very small amount of precipitation observed

B-: small amount of precipitation observed

C: small amount of precipitation observed and viscosity slightly increased

D: large amount of precipitation observed or gelling occurred

TABLE 2

| | Surface-treatment solution | | | | | | | | | | | | | | | | | |
|---|---|---|---|---|---|---|---|---|---|---|---|---|---|---|---|---|---|---|
| | Component | | | | | | | | Mass ratio | | | | | | | | | |
| No. | (A) | (B) | (C) | (D) | (E) | (F) | (G) | (H) | $A_S/X_S$ | $B_S/X_S$ | $C_Z/X_S$ | $X_S/D_S$ | $E_V/(X_S+D_S)$ | $F_M/(X_S+D_S)$ | $G_S/(X_S+G_S)$ | $H_S/(X_S+D_S)$ | pH | Category |
| 1 | A1 | B1 | C2 | D4 | E1 | F1 | — | — | 0.22 | 0.178 | 0.60 | 0.24 | 0.0033 | 0.0067 | 0.000 | 0.000 | 9.0 | Example |
| 2 | A1 | B1 | C2 | D4 | E1 | F1 | — | — | 0.26 | 0.138 | 0.60 | 0.24 | 0.0033 | 0.0067 | 0.000 | 0.000 | 9.0 | Example |
| 3 | A1 | B1 | C2 | D4 | E1 | F1 | — | — | 0.31 | 0.086 | 0.60 | 0.24 | 0.0033 | 0.0067 | 0.000 | 0.000 | 9.0 | Example |
| 4 | A1 | B1 | C2 | D4 | E1 | F1 | — | — | 0.31 | 0.086 | 0.60 | 0.24 | 0.0033 | 0.0067 | 0.000 | 0.000 | 8.0 | Example |
| 5 | A1 | B1 | C2 | D4 | E1 | F1 | — | — | 0.31 | 0.086 | 0.60 | 0.24 | 0.0033 | 0.0067 | 0.000 | 0.000 | 8.5 | Example |

TABLE 2-continued

| | Surface-treatment solution | | | | | | | | | | | | | | | | | |
|---|---|---|---|---|---|---|---|---|---|---|---|---|---|---|---|---|---|---|
| | Component | | | | | | | | Mass ratio | | | | | | | | | |
| No. | (A) | (B) | (C) | (D) | (E) | (F) | (G) | (H) | $A_S/X_S$ | $B_S/X_S$ | $C_Z/X_S$ | $X_S/D_S$ | $E_V/(X_S+D_S)$ | $F_M/(X_S+D_S)$ | $G_S/(X_S+G_S)$ | $H_S/(X_S+D_S)$ | pH | Category |
| 6 | A1 | B1 | C2 | D4 | E1 | F1 | — | — | 0.31 | 0.086 | 0.60 | 0.24 | 0.0033 | 0.0067 | 0.000 | 0.000 | 9.5 | Example |
| 7 | A1 | B1 | C2 | D4 | E1 | F1 | — | — | 0.31 | 0.086 | 0.60 | 0.24 | 0.0033 | 0.0067 | 0.000 | 0.000 | 10.0 | Example |
| 8 | A1 | B1 | C2 | D4 | E1 | F1 | — | — | 0.31 | 0.086 | 0.60 | 0.24 | 0.0033 | 0.0067 | 0.000 | 0.000 | 9.0 | Example |
| 9 | A1 | B1 | C2 | D4 | E1 | F1 | — | — | 0.31 | 0.086 | 0.60 | 0.24 | 0.0033 | 0.0067 | 0.000 | 0.000 | 9.0 | Example |
| 10 | A1 | B1 | C2 | D4 | E1 | F1 | — | — | 0.31 | 0.086 | 0.60 | 0.24 | 0.0033 | 0.0067 | 0.000 | 0.000 | 9.0 | Example |
| 11 | A1 | B1 | C2 | D4 | E1 | F1 | — | — | 0.31 | 0.086 | 0.60 | 0.24 | 0.0033 | 0.0067 | 0.000 | 0.000 | 9.0 | Example |
| 12 | A1 | B1 | C2 | D4 | E1 | F1 | — | — | 0.36 | 0.086 | 0.56 | 0.24 | 0.0033 | 0.0067 | 0.000 | 0.000 | 9.0 | Example |
| 13 | A1 | B1 | C2 | D4 | E1 | F1 | — | — | 0.39 | 0.086 | 0.52 | 0.24 | 0.0033 | 0.0067 | 0.000 | 0.000 | 9.0 | Example |
| 14 | A1 | B1 | C2 | D4 | E1 | F1 | G1 | — | 0.39 | 0.086 | 0.52 | 0.24 | 0.0033 | 0.0067 | 0.001 | 0.000 | 9.0 | Example |
| 15 | A1 | B1 | C2 | D4 | E1 | F1 | G1 | — | 0.39 | 0.086 | 0.52 | 0.24 | 0.0033 | 0.0067 | 0.006 | 0.000 | 9.0 | Example |
| 16 | A1 | B1 | C2 | D4 | E1 | F1 | G1 | — | 0.38 | 0.085 | 0.51 | 0.24 | 0.0033 | 0.0067 | 0.017 | 0.000 | 9.0 | Example |
| 17 | A1 | B1 | C2 | D4 | E1 | F1 | — | — | 0.31 | 0.023 | 0.67 | 0.24 | 0.0033 | 0.0067 | 0.000 | 0.000 | 9.0 | Example |
| 18 | A1 | B1 | C2 | D4 | E1 | F1 | — | — | 0.32 | 0.054 | 0.63 | 0.24 | 0.0033 | 0.0067 | 0.000 | 0.000 | 9.0 | Example |
| 19 | A2 | B1 | C2 | D4 | E1 | F1 | — | — | 0.31 | 0.086 | 0.60 | 0.24 | 0.0033 | 0.0067 | 0.000 | 0.000 | 8.0 | Example |
| 20 | A2 | B1 | C2 | D4 | E1 | F1 | — | — | 0.31 | 0.086 | 0.60 | 0.24 | 0.0033 | 0.0067 | 0.000 | 0.000 | 8.5 | Example |
| 21 | A2 | B1 | C2 | D4 | E1 | F1 | — | — | 0.31 | 0.086 | 0.60 | 0.24 | 0.0033 | 0.0067 | 0.000 | 0.000 | 9.5 | Example |
| 22 | A2 | B1 | C2 | D4 | E1 | F1 | — | — | 0.31 | 0.086 | 0.60 | 0.24 | 0.0033 | 0.0067 | 0.000 | 0.000 | 10.0 | Example |
| 23 | A1 | B2 | C2 | D4 | E1 | F1 | — | — | 0.31 | 0.086 | 0.60 | 0.24 | 0.0033 | 0.0067 | 0.000 | 0.000 | 9.0 | Example |
| 24 | A1 | B1 | C2 | D4 | E1 | F1 | — | — | 0.28 | 0.212 | 0.51 | 0.24 | 0.0033 | 0.0067 | 0.000 | 0.000 | 9.0 | Example |
| 25 | A1 | B1 | C2 | D4 | E1 | F1 | — | — | 0.25 | 0.260 | 0.49 | 0.24 | 0.0033 | 0.0067 | 0.000 | 0.000 | 9.0 | Example |
| 26 | A1 | B1 | C2 | D4 | E1 | F1 | — | — | 0.33 | 0.188 | 0.48 | 0.24 | 0.0033 | 0.0067 | 0.000 | 0.000 | 9.0 | Example |
| 27 | A1 | B1 | C2 | D4 | E1 | F1 | — | — | 0.34 | 0.173 | 0.49 | 0.24 | 0.0033 | 0.0067 | 0.000 | 0.000 | 9.0 | Example |
| 28 | A1 | B1 | C1 | D4 | E1 | F1 | — | — | 0.31 | 0.086 | 0.60 | 0.24 | 0.0033 | 0.0067 | 0.000 | 0.000 | 9.0 | Example |
| 29 | A1 | B1 | C2 | D3 | E1 | F1 | — | — | 0.31 | 0.086 | 0.60 | 0.24 | 0.0033 | 0.0067 | 0.000 | 0.000 | 8.0 | Example |
| 30 | A1 | B1 | C2 | D3 | E1 | F1 | — | — | 0.31 | 0.086 | 0.60 | 0.24 | 0.0033 | 0.0067 | 0.000 | 0.000 | 8.5 | Example |
| 31 | A1 | B1 | C2 | D3 | E1 | F1 | — | — | 0.31 | 0.086 | 0.60 | 0.24 | 0.0033 | 0.0067 | 0.000 | 0.000 | 9.0 | Example |
| 32 | A1 | B1 | C2 | D3 | E1 | F1 | — | — | 0.31 | 0.086 | 0.60 | 0.24 | 0.0033 | 0.0067 | 0.000 | 0.000 | 9.5 | Example |
| 33 | A1 | B1 | C2 | D3 | E1 | F1 | — | — | 0.31 | 0.086 | 0.60 | 0.24 | 0.0033 | 0.0067 | 0.000 | 0.000 | 10.0 | Example |
| 34 | A1 | B1 | C2 | D3 | E1 | F1 | — | — | 0.31 | 0.086 | 0.60 | 0.24 | 0.0033 | 0.0067 | 0.000 | 0.000 | 9.0 | Example |
| 35 | A1 | B1 | C2 | D3 | E1 | F1 | — | — | 0.31 | 0.086 | 0.60 | 0.24 | 0.0033 | 0.0067 | 0.000 | 0.000 | 9.0 | Example |
| 36 | A1 | B1 | C2 | D3 | E1 | F1 | — | — | 0.31 | 0.086 | 0.60 | 0.24 | 0.0033 | 0.0067 | 0.000 | 0.000 | 9.0 | Example |
| 37 | A1 | B1 | C2 | D3 | E1 | F1 | — | — | 0.31 | 0.086 | 0.60 | 0.24 | 0.0033 | 0.0067 | 0.000 | 0.000 | 9.0 | Example |
| 38 | A1 | B1 | C2 | D4 | E1 | F1 | — | — | 0.27 | 0.076 | 0.65 | 0.24 | 0.0033 | 0.0067 | 0.000 | 0.000 | 9.0 | Example |
| 39 | A1 | B1 | C2 | D4 | E1 | F1 | — | — | 0.27 | 0.054 | 0.67 | 0.24 | 0.0033 | 0.0067 | 0.000 | 0.000 | 9.0 | Example |
| 40 | A1 | B1 | C2 | D4 | E1 | F1 | — | — | 0.31 | 0.086 | 0.60 | 0.08 | 0.0033 | 0.0067 | 0.000 | 0.000 | 9.0 | Example |
| 41 | A1 | B1 | C2 | D4 | E1 | F1 | — | — | 0.31 | 0.086 | 0.60 | 0.15 | 0.0033 | 0.0067 | 0.000 | 0.000 | 9.0 | Example |
| 42 | A2 | B2 | C2 | D3 | E1 | F1 | — | — | 0.31 | 0.086 | 0.60 | 0.24 | 0.0033 | 0.0067 | 0.000 | 0.000 | 9.0 | Example |
| 43 | A2 | B2 | C2 | D5 | E1 | F1 | — | — | 0.31 | 0.086 | 0.60 | 0.24 | 0.0033 | 0.0067 | 0.000 | 0.000 | 9.0 | Example |
| 44 | A2 | B2 | C2 | D6 | E1 | F1 | — | — | 0.31 | 0.086 | 0.60 | 0.24 | 0.0033 | 0.0067 | 0.000 | 0.000 | 9.0 | Example |
| 45 | A2 | B2 | C2 | D7 | E1 | F1 | — | — | 0.31 | 0.086 | 0.60 | 0.24 | 0.0033 | 0.0067 | 0.000 | 0.000 | 9.0 | Example |
| 46 | A2 | B2 | C2 | D8 | E1 | F1 | — | — | 0.31 | 0.086 | 0.60 | 0.24 | 0.0033 | 0.0067 | 0.000 | 0.000 | 9.0 | Example |
| 47 | A2 | B2 | C2 | D9 | E1 | F1 | — | — | 0.31 | 0.086 | 0.60 | 0.24 | 0.0033 | 0.0067 | 0.000 | 0.000 | 9.0 | Example |
| 48 | A1 | B1 | C2 | D4 | E1 | F1 | — | — | 0.31 | 0.086 | 0.60 | 0.30 | 0.0033 | 0.0067 | 0.000 | 0.000 | 9.0 | Example |
| 49 | A1 | B1 | C2 | D4 | E1 | F1 | — | — | 0.31 | 0.086 | 0.60 | 0.34 | 0.0033 | 0.0067 | 0.000 | 0.000 | 9.0 | Example |
| 50 | A1 | B1 | C2 | D4 | E1 | F1 | G1 | — | 0.31 | 0.086 | 0.60 | 0.34 | 0.0033 | 0.0067 | 0.001 | 0.000 | 9.0 | Example |
| 51 | A1 | B1 | C2 | D4 | E1 | F1 | G1 | — | 0.31 | 0.086 | 0.60 | 0.34 | 0.0033 | 0.0067 | 0.005 | 0.000 | 9.0 | Example |
| 52 | A1 | B1 | C2 | D4 | E1 | F1 | G1 | — | 0.31 | 0.085 | 0.59 | 0.35 | 0.0033 | 0.0067 | 0.015 | 0.000 | 9.0 | Example |
| 53 | A1 | B1 | C2 | D4 | E1 | F1 | G1 | — | 0.30 | 0.084 | 0.59 | 0.35 | 0.0033 | 0.0066 | 0.028 | 0.000 | 9.0 | Example |
| 54 | A1 | B1 | C2 | D4 | E1 | F1 | G1 | — | 0.30 | 0.083 | 0.58 | 0.35 | 0.0033 | 0.0065 | 0.043 | 0.000 | 9.0 | Example |
| 55 | A1 | B1 | C2 | D4 | E1 | F1 | G1 | — | 0.30 | 0.082 | 0.57 | 0.35 | 0.0032 | 0.0064 | 0.049 | 0.000 | 9.0 | Example |
| 56 | A1 | B1 | C2 | D4 | E1 | F1 | — | — | 0.31 | 0.086 | 0.60 | 0.24 | 0.0013 | 0.0067 | 0.000 | 0.000 | 9.0 | Example |
| 57 | A1 | B1 | C2 | D4 | E1 | F1 | — | — | 0.31 | 0.086 | 0.60 | 0.24 | 0.0020 | 0.0067 | 0.000 | 0.000 | 9.0 | Example |
| 58 | A2 | B2 | C2 | D4 | E1 | F1 | — | — | 0.31 | 0.086 | 0.60 | 0.24 | 0.0033 | 0.0067 | 0.000 | 0.000 | 9.0 | Example |
| 59 | A1 | B1 | C2 | D4 | E2 | F1 | — | — | 0.31 | 0.086 | 0.60 | 0.24 | 0.0033 | 0.0067 | 0.000 | 0.000 | 9.0 | Example |
| 60 | A1 | B1 | C2 | D4 | E1 | F2 | — | — | 0.31 | 0.086 | 0.60 | 0.24 | 0.0033 | 0.0067 | 0.000 | 0.000 | 9.0 | Example |
| 61 | A1 | B1 | C2 | D4 | E1 | F1 | — | — | 0.31 | 0.086 | 0.60 | 0.24 | 0.0089 | 0.0067 | 0.000 | 0.000 | 9.0 | Example |
| 62 | A1 | B1 | C2 | D4 | E1 | F1 | — | — | 0.31 | 0.086 | 0.60 | 0.24 | 0.0122 | 0.0067 | 0.000 | 0.000 | 9.0 | Example |
| 63 | A1 | B1 | C2 | D4 | E1 | F1 | G1 | — | 0.31 | 0.086 | 0.60 | 0.24 | 0.0122 | 0.0067 | 0.003 | 0.000 | 9.0 | Example |
| 64 | A1 | B1 | C2 | D4 | E1 | F1 | G1 | — | 0.31 | 0.086 | 0.60 | 0.24 | 0.0122 | 0.0067 | 0.006 | 0.000 | 9.0 | Example |
| 65 | A1 | B1 | C2 | D4 | E1 | F1 | G1 | — | 0.31 | 0.085 | 0.59 | 0.24 | 0.0122 | 0.0067 | 0.017 | 0.000 | 9.0 | Example |
| 66 | A1 | B1 | C2 | D4 | E1 | F1 | — | — | 0.31 | 0.086 | 0.60 | 0.24 | 0.0033 | 0.0013 | 0.000 | 0.000 | 9.0 | Example |
| 67 | A1 | B1 | C2 | D4 | E1 | F1 | — | — | 0.31 | 0.086 | 0.60 | 0.24 | 0.0033 | 0.0033 | 0.000 | 0.000 | 9.0 | Example |
| 68 | A2 | B2 | C2 | D4 | E2 | F1 | — | — | 0.31 | 0.086 | 0.60 | 0.24 | 0.0033 | 0.0067 | 0.000 | 0.000 | 9.0 | Example |
| 69 | A2 | B2 | C2 | D4 | E2 | F2 | — | — | 0.31 | 0.086 | 0.60 | 0.24 | 0.0033 | 0.0067 | 0.000 | 0.000 | 9.0 | Example |
| 70 | A1 | B1 | C2 | D4 | E1 | F1 | — | — | 0.31 | 0.086 | 0.60 | 0.24 | 0.0033 | 0.0100 | 0.000 | 0.000 | 9.0 | Example |
| 71 | A1 | B1 | C2 | D4 | E1 | F1 | — | — | 0.31 | 0.086 | 0.60 | 0.24 | 0.0033 | 0.0134 | 0.000 | 0.000 | 9.0 | Example |
| 72 | A1 | B1 | C2 | D4 | E1 | F1 | G1 | — | 0.29 | 0.082 | 0.57 | 0.25 | 0.0033 | 0.0066 | 0.054 | 0.000 | 9.0 | Example |
| 73 | A1 | B1 | C2 | D4 | E1 | F1 | G1 | — | 0.28 | 0.077 | 0.54 | 0.27 | 0.0033 | 0.0065 | 0.103 | 0.000 | 9.0 | Example |
| 74 | A2 | B2 | C2 | D4 | E2 | F1 | G1 | — | 0.26 | 0.072 | 0.50 | 0.29 | 0.0032 | 0.0064 | 0.167 | 0.000 | 9.0 | Example |
| 75 | A1 | B1 | C2 | D4 | E1 | F1 | G2 | — | 0.26 | 0.072 | 0.50 | 0.29 | 0.0032 | 0.0064 | 0.167 | 0.000 | 8.0 | Example |
| 76 | A1 | B1 | C2 | D4 | E1 | F1 | G2 | — | 0.26 | 0.072 | 0.50 | 0.29 | 0.0032 | 0.0064 | 0.167 | 0.000 | 8.5 | Example |
| 77 | A1 | B1 | C2 | D4 | E1 | F1 | G2 | — | 0.26 | 0.072 | 0.50 | 0.29 | 0.0032 | 0.0064 | 0.167 | 0.000 | 9.0 | Example |

TABLE 2-continued

| | Surface-treatment solution | | | | | | | | | | | | | | | | | |
|---|---|---|---|---|---|---|---|---|---|---|---|---|---|---|---|---|---|---|
| | Component | | | | | | | | Mass ratio | | | | | | | | | |
| No. | (A) | (B) | (C) | (D) | (E) | (F) | (G) | (H) | $A_S/X_S$ | $B_S/X_S$ | $C_Z/X_S$ | $X_S/D_S$ | $E_V/(X_S+D_S)$ | $F_M/(X_S+D_S)$ | $G_S/(X_S+G_S)$ | $H_S/(X_S+D_S)$ | pH | Category |
| 78 | A1 | B1 | C2 | D4 | E1 | F1 | G2 | — | 0.26 | 0.072 | 0.50 | 0.29 | 0.0032 | 0.0064 | 0.167 | 0.000 | 9.5 | Example |
| 79 | A1 | B1 | C2 | D4 | E1 | F1 | G2 | — | 0.26 | 0.072 | 0.50 | 0.29 | 0.0032 | 0.0064 | 0.167 | 0.000 | 10.0 | Example |
| 80 | A1 | B1 | C2 | D4 | E1 | F1 | G2 | — | 0.26 | 0.072 | 0.50 | 0.29 | 0.0032 | 0.0064 | 0.167 | 0.000 | 9.0 | Example |
| 81 | A1 | B1 | C2 | D4 | E1 | F1 | G2 | — | 0.26 | 0.072 | 0.50 | 0.29 | 0.0032 | 0.0064 | 0.167 | 0.000 | 9.0 | Example |
| 82 | A1 | B1 | C2 | D4 | E1 | F1 | G2 | — | 0.26 | 0.072 | 0.50 | 0.29 | 0.0032 | 0.0064 | 0.167 | 0.000 | 9.0 | Example |
| 83 | A1 | B1 | C2 | D4 | E1 | F1 | G2 | — | 0.26 | 0.072 | 0.50 | 0.29 | 0.0032 | 0.0064 | 0.167 | 0.000 | 9.0 | Example |
| 84 | A1 | B1 | C2 | D4 | E1 | F1 | G1 | — | 0.26 | 0.072 | 0.50 | 0.29 | 0.0032 | 0.0064 | 0.167 | 0.000 | 8.0 | Example |
| 85 | A1 | B1 | C2 | D4 | E1 | F1 | G1 | — | 0.26 | 0.072 | 0.50 | 0.29 | 0.0032 | 0.0064 | 0.167 | 0.000 | 10.0 | Example |
| 86 | A1 | B1 | C2 | D4 | E1 | F1 | G1 | — | 0.25 | 0.069 | 0.49 | 0.30 | 0.0032 | 0.0064 | 0.194 | 0.000 | 9.0 | Example |
| 87 | A2 | B2 | C2 | D4 | E2 | F1 | G2 | — | 0.25 | 0.069 | 0.49 | 0.30 | 0.0032 | 0.0064 | 0.194 | 0.000 | 9.0 | Example |
| 88 | A1 | B1 | C2 | D4 | E1 | F1 | — | H1 | 0.31 | 0.086 | 0.60 | 0.24 | 0.0033 | 0.0067 | 0.000 | 0.011 | 9.0 | Example |
| 89 | A1 | B1 | C2 | D4 | E1 | F1 | — | H1 | 0.31 | 0.086 | 0.60 | 0.24 | 0.0033 | 0.0067 | 0.000 | 0.033 | 9.0 | Example |
| 90 | A1 | B1 | C2 | D4 | E1 | F1 | — | H2 | 0.31 | 0.086 | 0.60 | 0.24 | 0.0033 | 0.0067 | 0.000 | 0.033 | 9.0 | Example |
| 91 | A2 | B2 | C2 | D4 | E2 | F1 | — | H1 | 0.31 | 0.086 | 0.60 | 0.24 | 0.0033 | 0.0067 | 0.000 | 0.033 | 8.0 | Example |
| 92 | A2 | B2 | C2 | D4 | E2 | F1 | — | H1 | 0.31 | 0.086 | 0.60 | 0.24 | 0.0033 | 0.0067 | 0.000 | 0.033 | 8.5 | Example |
| 93 | A2 | B2 | C2 | D4 | E2 | F1 | — | H1 | 0.31 | 0.086 | 0.60 | 0.24 | 0.0033 | 0.0067 | 0.000 | 0.033 | 9.0 | Example |
| 94 | A2 | B2 | C2 | D4 | E2 | F1 | — | H1 | 0.31 | 0.086 | 0.60 | 0.24 | 0.0033 | 0.0067 | 0.000 | 0.033 | 9.5 | Example |
| 95 | A2 | B2 | C2 | D4 | E2 | F1 | — | H1 | 0.31 | 0.086 | 0.60 | 0.24 | 0.0033 | 0.0067 | 0.000 | 0.033 | 10.0 | Example |
| 96 | A1 | B1 | C2 | D4 | E1 | F1 | — | H1 | 0.31 | 0.086 | 0.60 | 0.24 | 0.0033 | 0.0067 | 0.000 | 0.033 | 8.0 | Example |
| 97 | A1 | B1 | C2 | D4 | E1 | F1 | — | H1 | 0.31 | 0.086 | 0.60 | 0.24 | 0.0033 | 0.0067 | 0.000 | 0.033 | 8.5 | Example |
| 98 | A1 | B1 | C2 | D4 | E1 | F1 | — | H1 | 0.31 | 0.086 | 0.60 | 0.24 | 0.0033 | 0.0067 | 0.000 | 0.033 | 9.0 | Example |
| 99 | A1 | B1 | C2 | D4 | E1 | F1 | — | H1 | 0.31 | 0.086 | 0.60 | 0.24 | 0.0033 | 0.0067 | 0.000 | 0.033 | 9.5 | Example |
| 100 | A1 | B1 | C2 | D4 | E1 | F1 | — | H1 | 0.31 | 0.086 | 0.60 | 0.24 | 0.0033 | 0.0067 | 0.000 | 0.033 | 10.0 | Example |
| 101 | A1 | B1 | C2 | D4 | E1 | F1 | — | H1 | 0.31 | 0.086 | 0.60 | 0.24 | 0.0033 | 0.0067 | 0.000 | 0.033 | 9.0 | Example |
| 102 | A1 | B1 | C2 | D4 | E1 | F1 | — | H1 | 0.31 | 0.086 | 0.60 | 0.24 | 0.0033 | 0.0067 | 0.000 | 0.033 | 9.0 | Example |
| 103 | A1 | B1 | C2 | D4 | E1 | F1 | — | H1 | 0.31 | 0.086 | 0.60 | 0.24 | 0.0033 | 0.0067 | 0.000 | 0.033 | 9.0 | Example |
| 104 | A1 | B1 | C2 | D4 | E1 | F1 | — | H1 | 0.31 | 0.086 | 0.60 | 0.24 | 0.0033 | 0.0067 | 0.000 | 0.033 | 9.0 | Example |
| 105 | A1 | B1 | C2 | D4 | E1 | F1 | — | H1 | 0.31 | 0.086 | 0.60 | 0.24 | 0.0033 | 0.0067 | 0.000 | 0.042 | 9.0 | Example |
| 106 | A2 | B2 | C2 | D4 | E2 | F1 | — | H2 | 0.31 | 0.086 | 0.60 | 0.24 | 0.0033 | 0.0067 | 0.000 | 0.067 | 9.0 | Example |
| 107 | A1 | B1 | C2 | D4 | E1 | F1 | G1 | H1 | 0.29 | 0.082 | 0.57 | 0.25 | 0.0033 | 0.0066 | 0.054 | 0.011 | 9.0 | Example |
| 108 | A1 | B1 | C2 | D4 | E1 | F1 | G1 | H1 | 0.28 | 0.077 | 0.54 | 0.27 | 0.0033 | 0.0065 | 0.103 | 0.033 | 9.0 | Example |
| 109 | A1 | B1 | C2 | D4 | E1 | F1 | G2 | H1 | 0.26 | 0.072 | 0.50 | 0.29 | 0.0032 | 0.0064 | 0.167 | 0.032 | 9.0 | Example |
| 110 | A2 | B2 | C2 | D4 | E2 | F1 | G1 | H1 | 0.26 | 0.072 | 0.50 | 0.29 | 0.0032 | 0.0064 | 0.167 | 0.032 | 9.0 | Example |
| 111 | A1 | B1 | C2 | D4 | E1 | F1 | G1 | H1 | 0.26 | 0.072 | 0.50 | 0.29 | 0.0032 | 0.0064 | 0.167 | 0.032 | 8.0 | Example |
| 112 | A1 | B1 | C2 | D4 | E1 | F1 | G1 | H1 | 0.26 | 0.072 | 0.50 | 0.29 | 0.0032 | 0.0064 | 0.167 | 0.032 | 8.5 | Example |
| 113 | A1 | B1 | C2 | D4 | E1 | F1 | G1 | H1 | 0.26 | 0.072 | 0.50 | 0.29 | 0.0032 | 0.0064 | 0.167 | 0.032 | 9.0 | Example |
| 114 | A1 | B1 | C2 | D4 | E1 | F1 | G1 | H1 | 0.26 | 0.072 | 0.50 | 0.29 | 0.0032 | 0.0064 | 0.167 | 0.032 | 9.5 | Example |
| 115 | A1 | B1 | C2 | D4 | E1 | F1 | G1 | H1 | 0.26 | 0.072 | 0.50 | 0.29 | 0.0032 | 0.0064 | 0.167 | 0.032 | 10.0 | Example |
| 116 | A1 | B1 | C2 | D4 | E1 | F1 | G1 | H1 | 0.26 | 0.072 | 0.50 | 0.29 | 0.0032 | 0.0064 | 0.167 | 0.032 | 9.0 | Example |
| 117 | A1 | B1 | C2 | D4 | E1 | F1 | G1 | H1 | 0.26 | 0.072 | 0.50 | 0.29 | 0.0032 | 0.0064 | 0.167 | 0.032 | 9.0 | Example |
| 118 | A1 | B1 | C2 | D4 | E1 | F1 | G1 | H1 | 0.26 | 0.072 | 0.50 | 0.29 | 0.0032 | 0.0064 | 0.167 | 0.032 | 9.0 | Example |
| 119 | A1 | B1 | C2 | D4 | E1 | F1 | G1 | H1 | 0.26 | 0.072 | 0.50 | 0.29 | 0.0032 | 0.0064 | 0.167 | 0.032 | 9.0 | Example |
| 120 | A1 | B1 | C2 | D4 | E1 | F1 | G2 | H2 | 0.26 | 0.072 | 0.50 | 0.29 | 0.0032 | 0.0064 | 0.167 | 0.032 | 9.0 | Example |
| 121 | A2 | B2 | C2 | D4 | E2 | F1 | G1 | H2 | 0.25 | 0.069 | 0.49 | 0.30 | 0.0032 | 0.0064 | 0.194 | 0.064 | 9.0 | Example |
| 122 | A2 | B2 | C2 | D4 | E2 | F1 | G1 | H2 | 0.25 | 0.069 | 0.49 | 0.30 | 0.0032 | 0.0064 | 0.194 | 0.096 | 9.0 | Example |
| 123 | A1 | B1 | C2 | D4 | E1 | F1 | — | — | 0.31 | 0.086 | 0.60 | 0.24 | 0.0033 | 0.0067 | 0.000 | 0.000 | 9.0 | Example |
| 124 | A1 | B1 | C2 | D4 | E1 | F1 | — | — | 0.31 | 0.086 | 0.60 | 0.24 | 0.0033 | 0.0067 | 0.000 | 0.000 | 9.0 | Example |
| 125 | A1 | B1 | C2 | D4 | E1 | F1 | — | — | 0.31 | 0.086 | 0.60 | 0.24 | 0.0033 | 0.0067 | 0.000 | 0.000 | 9.0 | Example |
| 126 | A1 | B1 | C2 | D4 | E1 | F1 | — | — | 0.31 | 0.086 | 0.60 | 0.24 | 0.0033 | 0.0067 | 0.000 | 0.000 | 9.0 | Example |
| 127 | A1 | B1 | C2 | D4 | E1 | F1 | — | — | 0.31 | 0.086 | 0.60 | 0.24 | 0.0033 | 0.0067 | 0.000 | 0.000 | 9.0 | Example |
| 128 | A1 | B1 | C2 | D4 | E1 | F1 | — | — | 0.31 | 0.086 | 0.60 | 0.24 | 0.0033 | 0.0067 | 0.000 | 0.000 | 9.0 | Example |
| 129 | A1 | B1 | C2 | D4 | E1 | F1 | — | — | 0.31 | 0.086 | 0.60 | 0.24 | 0.0033 | 0.0067 | 0.000 | 0.000 | 9.0 | Example |
| 130 | A1 | B1 | C2 | D4 | E1 | F1 | — | — | 0.31 | 0.086 | 0.60 | 0.24 | 0.0033 | 0.0067 | 0.000 | 0.000 | 9.0 | Example |
| 131 | A1 | B1 | C2 | D4 | E1 | F1 | — | — | 0.31 | 0.086 | 0.60 | 0.24 | 0.0033 | 0.0067 | 0.000 | 0.000 | 9.0 | Example |
| 132 | A1 | B1 | C2 | D4 | E1 | F1 | — | — | 0.31 | 0.086 | 0.60 | 0.24 | 0.0033 | 0.0067 | 0.000 | 0.000 | 9.0 | Example |
| 133 | A1 | B2 | C2 | D4 | E1 | F2 | — | — | 0.31 | 0.086 | 0.60 | 0.24 | 0.0033 | 0.0067 | 0.000 | 0.000 | 9.0 | Example |
| 134 | A1 | B2 | C2 | D4 | E1 | F2 | — | — | 0.31 | 0.086 | 0.60 | 0.24 | 0.0033 | 0.0067 | 0.000 | 0.000 | 9.0 | Example |
| 135 | A1 | B2 | C2 | D4 | E1 | F2 | — | — | 0.31 | 0.086 | 0.60 | 0.24 | 0.0033 | 0.0067 | 0.000 | 0.000 | 9.0 | Example |
| 136 | A1 | B2 | C2 | D4 | E1 | F2 | — | — | 0.31 | 0.086 | 0.60 | 0.24 | 0.0033 | 0.0067 | 0.000 | 0.000 | 9.0 | Example |
| 137 | — | B1 | C2 | D4 | E1 | F1 | — | — | 0.00 | 0.300 | 0.70 | 0.24 | 0.0033 | 0.0067 | 0.000 | 0.000 | 9.0 | Comparative Example |
| 138 | A1 | — | C2 | D4 | E1 | F1 | — | — | 0.34 | 0.000 | 0.66 | 0.24 | 0.0033 | 0.0067 | 0.000 | 0.000 | 9.0 | Comparative Example |
| 139 | A1 | B1 | — | D4 | E1 | F1 | — | — | 0.60 | 0.400 | 0.00 | 0.24 | 0.0033 | 0.0067 | 0.000 | 0.000 | 9.0 | Comparative Example |
| 140 | A1 | B1 | C2 | — | E1 | F1 | — | — | 0.31 | 0.086 | 0.60 | — | 0.0029 | 0.0069 | 0.000 | 0.000 | 9.0 | Comparative Example |
| 141 | A1 | B1 | C2 | D4 | — | F1 | — | — | 0.31 | 0.086 | 0.60 | 0.24 | 0.0000 | 0.0067 | 0.000 | 0.000 | 9.0 | Comparative Example |
| 142 | A1 | B1 | C2 | D4 | E1 | — | — | — | 0.31 | 0.086 | 0.60 | 0.24 | 0.0033 | 0.0000 | 0.000 | 0.000 | 9.0 | Comparative Example |

TABLE 2-continued

| | Surface-treatment solution | | | | | | | | | | | | | | | | | |
|---|---|---|---|---|---|---|---|---|---|---|---|---|---|---|---|---|---|---|
| | Component | | | | | | | | Mass ratio | | | | | | | | | |
| No. | (A) | (B) | (C) | (D) | (E) | (F) | (G) | (H) | $A_S/X_S$ | $B_S/X_S$ | $C_Z/X_S$ | $X_S/D_S$ | $E_V/(X_S+D_S)$ | $F_M/(X_S+D_S)$ | $G_S/(X_S+G_S)$ | $H_S/(X_S+D_S)$ | pH | Category |
| 143 | A1 | B1 | C2 | D4 | E1 | F1 | — | — | 0.18 | 0.213 | 0.60 | 0.24 | 0.0033 | 0.0067 | 0.000 | 0.000 | 9.0 | Comparative Example |
| 144 | A1 | B1 | C2 | D4 | E1 | F1 | — | — | 0.42 | 0.084 | 0.50 | 0.24 | 0.0033 | 0.0067 | 0.000 | 0.000 | 9.0 | Comparative Example |
| 145 | A1 | B1 | C2 | D4 | E1 | F1 | — | — | 0.34 | 0.006 | 0.65 | 0.24 | 0.0033 | 0.0067 | 0.000 | 0.000 | 9.0 | Comparative Example |
| 146 | A1 | B1 | C2 | D4 | E1 | F1 | — | — | 0.24 | 0.308 | 0.45 | 0.24 | 0.0033 | 0.0067 | 0.000 | 0.000 | 9.0 | Comparative Example |
| 147 | A1 | B1 | C2 | D4 | E1 | F1 | — | — | 0.35 | 0.226 | 0.43 | 0.24 | 0.0033 | 0.0067 | 0.000 | 0.000 | 9.0 | Comparative Example |
| 148 | A1 | B1 | C2 | D4 | E1 | F1 | — | — | 0.24 | 0.037 | 0.72 | 0.24 | 0.0033 | 0.0067 | 0.000 | 0.000 | 9.0 | Comparative Example |
| 149 | A1 | B1 | C2 | D4 | E1 | F1 | — | — | 0.31 | 0.086 | 0.60 | 0.04 | 0.0033 | 0.0067 | 0.000 | 0.000 | 9.0 | Comparative Example |
| 150 | A1 | B1 | C2 | D4 | E1 | F1 | — | — | 0.31 | 0.086 | 0.60 | 0.36 | 0.0033 | 0.0067 | 0.000 | 0.000 | 9.0 | Comparative Example |
| 151 | A1 | B1 | C2 | D4 | E1 | F1 | — | — | 0.31 | 0.086 | 0.60 | 0.24 | 0.0008 | 0.0067 | 0.000 | 0.000 | 9.0 | Comparative Example |
| 152 | A1 | B1 | C2 | D4 | E1 | F1 | — | — | 0.31 | 0.086 | 0.60 | 0.24 | 0.0156 | 0.0067 | 0.000 | 0.000 | 9.0 | Comparative Example |
| 153 | A1 | B1 | C2 | D4 | E1 | F1 | — | — | 0.31 | 0.086 | 0.60 | 0.24 | 0.0200 | 0.0067 | 0.000 | 0.000 | 9.0 | Comparative Example |
| 154 | A1 | B1 | C2 | D4 | E1 | F1 | — | — | 0.31 | 0.086 | 0.60 | 0.24 | 0.0033 | 0.0008 | 0.000 | 0.000 | 9.0 | Comparative Example |
| 155 | A1 | B1 | C2 | D4 | E1 | F1 | — | — | 0.31 | 0.086 | 0.60 | 0.24 | 0.0033 | 0.0156 | 0.000 | 0.000 | 9.0 | Comparative Example |
| 156 | A1 | B1 | C2 | D4 | E1 | F1 | G1 | — | 0.24 | 0.066 | 0.46 | 0.31 | 0.0032 | 0.0063 | 0.237 | 0.000 | 9.0 | Example |
| 157 | A1 | B1 | C2 | D4 | E1 | F1 | G1 | H1 | 0.24 | 0.066 | 0.46 | 0.31 | 0.0032 | 0.0063 | 0.237 | 0.032 | 9.0 | Example |
| 158 | A1 | B1 | C2 | D1 | E1 | F1 | — | — | 0.31 | 0.086 | 0.60 | 0.24 | 0.0033 | 0.0067 | 0.000 | 0.000 | 9.0 | Comparative Example |
| 159 | A1 | B1 | C2 | D2 | E1 | F1 | — | — | 0.31 | 0.086 | 0.60 | 0.24 | 0.0033 | 0.0067 | 0.000 | 0.000 | 9.0 | Comparative Example |
| 160 | A1 | B1 | C2 | D10 | E1 | F1 | — | — | 0.31 | 0.086 | 0.60 | 0.24 | 0.0033 | 0.0067 | 0.000 | 0.000 | 9.0 | Comparative Example |
| 161 | A1 | B1 | C2 | D4 | E1 | F1 | — | — | 0.31 | 0.086 | 0.60 | 0.24 | 0.0033 | 0.0067 | 0.000 | 0.000 | 7.5 | Comparative Example |
| 162 | A1 | B1 | C2 | D4 | E1 | F1 | — | — | 0.31 | 0.086 | 0.60 | 0.24 | 0.0033 | 0.0067 | 0.000 | 0.000 | 12.0 | Comparative Example |

TABLE 3

| | Process condition | | | Performance evaluation | | | | | | | | | | | | |
|---|---|---|---|---|---|---|---|---|---|---|---|---|---|---|---|---|
| No. | Steel sheet | Coating weight ($mg/m^2$) | PMT (° C.) | Heat discoloration resistance | Heat cracking resistance | Planar part anti-corrosion property | Corrosion resistance after degreasing | Blackening resistance | Stack blackening resistance | Anti-water stain property | Solvent resistance | Perspiration resistance | Coating adhesion property | Lubricity | Storage stability | Category |
| 1 | III | 900 | 110 | B− | B | B− | B− | A | A | A | A | A | A | B | A | Example |
| 2 | III | 900 | 110 | B− | B− | B | B | A | A | A | A | A | A | B | A | Example |
| 3 | III | 900 | 110 | B− | B− | A | A | A | A | A | A | A | A | B | A | Example |
| 4 | III | 900 | 110 | B− | B− | A | A | A | A | A | A | A | A | B | B | Example |
| 5 | III | 900 | 110 | B− | B− | A | A | A | A | A | A | A | A | B | A | Example |
| 6 | III | 900 | 110 | B− | B− | A | A | A | A | A | A | A | A | B | A | Example |
| 7 | III | 900 | 110 | B− | B− | A | A | A | A | A | A | A | A | B | B | Example |
| 8 | I | 900 | 110 | B− | B− | A | A | A | A | A | A | A | A | B | A | Example |
| 9 | II | 900 | 110 | B− | B− | A | A | A | A | A | A | A | A | B | A | Example |
| 10 | IV | 900 | 110 | B− | B− | A | A | A | A | A | A | A | A | B | A | Example |
| 11 | V | 900 | 110 | B− | B− | A | A | A | A | A | A | A | A | B | A | Example |
| 12 | III | 900 | 110 | B− | B= | A | A | A | A | A | A | A | A | B | A | Example |
| 13 | III | 900 | 110 | B− | B= | A | A | A | A | A | A | A | A | B | A | Example |
| 14 | III | 900 | 110 | B | B= | A | A | A | A | A | A | A | A | B | A | Example |
| 15 | III | 900 | 110 | B | B− | A | A | A | A | A | A | A | A | B | A | Example |
| 16 | III | 900 | 110 | B | B | A | A | A | A | A | A | A | A | B | A | Example |
| 17 | III | 900 | 110 | B− | B= | A | A | A | A | A | A | A | B− | B | A | Example |
| 18 | III | 900 | 110 | B− | B= | A | A | A | A | A | A | A | A | B | A | Example |
| 19 | III | 900 | 110 | B− | B− | A | A | A | A | A | A | A | A | B | B | Example |
| 20 | III | 900 | 110 | B− | B− | A | A | A | A | A | A | A | A | B | A | Example |
| 21 | III | 900 | 110 | B− | B− | A | A | A | A | A | A | A | A | B | A | Example |
| 22 | III | 900 | 110 | B− | B− | A | A | A | A | A | A | A | A | B | B | Example |
| 23 | III | 900 | 110 | B− | B− | A | A | A | A | A | A | A | A | B | A | Example |
| 24 | III | 900 | 110 | B− | B | B | B | A | A | A | A | A | A | B | A | Example |
| 25 | III | 900 | 110 | B− | B | B− | B− | A | A | A | A | A | A | B | A | Example |
| 26 | III | 900 | 110 | B− | B | B | B | A | A | A | A | A | A | B | A | Example |
| 27 | III | 900 | 110 | B− | B | B | B | A | A | A | A | A | A | B | A | Example |
| 28 | III | 900 | 110 | B− | B− | B | B | A | A | A | B | A | A | B | A | Example |
| 29 | III | 900 | 110 | B− | B− | A | A | A | A | A | A | A | A | B | B | Example |
| 30 | III | 900 | 110 | B− | B− | A | A | A | A | A | A | A | A | B | A | Example |
| 31 | III | 900 | 110 | B− | B− | A | A | A | A | A | A | A | A | B | A | Example |
| 32 | III | 900 | 110 | B− | B− | A | A | A | A | A | A | A | A | B | A | Example |
| 33 | III | 900 | 110 | B− | B− | A | A | A | A | A | A | A | A | B | B | Example |
| 34 | I | 900 | 110 | B− | B− | A | A | A | A | A | A | A | A | B | A | Example |
| 35 | II | 900 | 110 | B− | B− | A | A | A | A | A | A | A | A | B | A | Example |
| 36 | IV | 900 | 110 | B− | B− | A | A | A | A | A | A | A | A | B | A | Example |
| 37 | V | 900 | 110 | B− | B− | A | A | A | A | A | A | A | A | B | A | Example |
| 38 | III | 900 | 110 | B− | B= | B | B | A | A | A | A | A | A | B | A | Example |
| 39 | III | 900 | 110 | B− | B= | B− | B− | A | A | A | A | A | B− | B | A | Example |
| 40 | III | 900 | 110 | B | B | B− | B− | A | A | A | B− | A | A | B | A | Example |
| 41 | III | 900 | 110 | B | B | B | B | A | A | A | B | A | A | B | A | Example |
| 42 | III | 900 | 110 | B− | B− | A | A | A | A | A | B− | A | A | B | A | Example |
| 43 | III | 900 | 110 | B− | B− | A | A | A | A | A | B | A | A | B | A | Example |
| 44 | III | 900 | 110 | B− | B− | A | A | A | A | A | A | A | A | B | A | Example |
| 45 | III | 900 | 110 | B− | B− | A | A | A | A | A | A | A | A | B | A | Example |

TABLE 3-continued

| | Process condition | | | Performance evaluation | | | | | | | | | | | | |
|---|---|---|---|---|---|---|---|---|---|---|---|---|---|---|---|---|
| No. | Steel sheet | Coating weight ($mg/m^2$) | PMT (° C.) | Heat discoloration resistance | Heat cracking resistance | Planar part anti-corrosion property | Corrosion resistance after degreasing | Blackening resistance | Stack blackening resistance | Anti-water stain property | Solvent resistance | Perspiration resistance | Coating adhesion property | Lubricity | Storage stability | Category |
| 46 | III | 900 | 110 | B− | B− | A | A | A | A | A | A | A | B | B | A | Example |
| 47 | III | 900 | 110 | B− | B− | A | A | A | A | A | A | A | B− | B | A | Example |
| 48 | III | 900 | 110 | B= | B= | A | A | B | B | B | A | B | B | B | A | Example |
| 49 | III | 900 | 110 | B= | B= | A | A | B− | B− | B− | A | B− | B− | B | A | Example |
| 50 | III | 900 | 110 | B= | B= | A | A | B− | B− | B− | A | B− | B− | B | A | Example |
| 51 | III | 900 | 110 | B− | B− | A | A | B− | B− | B− | A | B− | B− | B | A | Example |
| 52 | III | 900 | 110 | B | B | A | A | B− | B− | B− | A | B− | B− | B | A | Example |
| 53 | III | 900 | 110 | B | B | A | A | B− | B= | B− | A | B− | B− | B | A | Example |
| 54 | III | 900 | 110 | B | B | A | A | B− | B= | B− | A | B− | B− | B | A | Example |
| 55 | III | 900 | 110 | B | B | A | A | B− | B− | B− | A | B− | B− | B | A | Example |
| 56 | III | 900 | 110 | B | B | B− | A | A | A | A | A | A | A | B | A | Example |
| 57 | III | 900 | 110 | B | B | B | A | A | A | A | A | A | A | B | A | Example |
| 58 | III | 900 | 110 | B− | B− | A | A | A | A | A | A | A | A | B | A | Example |
| 59 | III | 900 | 110 | B− | B− | A | A | A | A | A | A | A | A | B | A | Example |
| 60 | III | 900 | 110 | B− | B− | A | A | A | A | A | A | A | A | B | A | Example |
| 61 | III | 900 | 110 | B= | B= | A | A | B | B | B | A | B | B | B | A | Example |
| 62 | III | 900 | 110 | B= | B= | A | A | B− | B− | B− | A | B− | B− | B | A | Example |
| 63 | III | 900 | 110 | B= | B= | A | A | B− | B− | B− | A | B− | B− | B | A | Example |
| 64 | III | 900 | 110 | B− | B− | A | A | B− | B− | B− | A | B− | B− | B | A | Example |
| 65 | III | 900 | 110 | B | B | A | A | B− | B− | B− | A | B− | B− | B | A | Example |
| 66 | III | 900 | 110 | B− | B− | A | A | B− | B− | A | A | A | A | B | A | Example |
| 67 | III | 900 | 110 | B− | B− | A | A | B | B | A | A | A | A | B | A | Example |
| 68 | III | 900 | 110 | B− | B− | A | A | A | A | A | A | A | A | B | A | Example |
| 69 | III | 900 | 110 | B− | B− | A | A | A | A | A | A | A | A | B | A | Example |
| 70 | III | 900 | 110 | B− | B− | B | B | A | A | A | A | A | A | B | A | Example |
| 71 | III | 900 | 110 | B− | B− | B− | B− | A | A | A | A | A | A | B | A | Example |
| 72 | III | 900 | 110 | B | B | A | A | A | B= | A | A | A | A | B | A | Example |
| 73 | III | 900 | 110 | B | B | A | A | A | B= | A | A | A | A | B | A | Example |
| 74 | III | 900 | 110 | B | B | A | A | A | B= | A | A | A | A | B | A | Example |
| 75 | III | 900 | 110 | B | B | A | A | A | B= | A | A | A | A | B | B | Example |
| 76 | III | 900 | 110 | B | B | A | A | A | B= | A | A | A | A | B | A | Example |
| 77 | III | 900 | 110 | B | B | A | A | A | B= | A | A | A | A | B | A | Example |
| 78 | III | 900 | 110 | B | B | A | A | A | B= | A | A | A | A | B | A | Example |
| 79 | III | 900 | 110 | B | B | A | A | A | B= | A | A | A | A | B | B | Example |
| 80 | I | 900 | 110 | B | B | A | A | A | B= | A | A | A | A | B | A | Example |
| 81 | II | 900 | 110 | B | B | A | A | A | B= | A | A | A | A | B | A | Example |
| 82 | IV | 900 | 110 | B | B | A | A | A | B= | A | A | A | A | B | A | Example |
| 83 | V | 900 | 110 | B | B | A | A | A | B= | A | A | A | A | B | A | Example |
| 84 | III | 900 | 110 | B | B | A | A | A | B= | A | A | A | A | B | B | Example |
| 85 | III | 900 | 110 | B | B | A | A | A | B= | A | A | A | A | B | B | Example |
| 86 | III | 900 | 110 | B | B | A | A | A | B= | A | A | A | A | B | A | Example |
| 87 | III | 900 | 110 | B | B | A | A | A | B= | A | A | A | A | B | A | Example |
| 88 | III | 900 | 110 | B− | B− | A | A | A | A | A | A | A | A | A | A | Example |
| 89 | III | 900 | 110 | B− | B− | A | A | A | A | A | A | A | A | A | A | Example |
| 90 | III | 900 | 110 | B− | B− | A | A | A | A | A | A | A | A | A | A | Example |
| 91 | III | 900 | 110 | B− | B− | A | A | A | A | A | A | A | A | A | B | Example |
| 92 | III | 900 | 110 | B− | B− | A | A | A | A | A | A | A | A | A | A | Example |

TABLE 3-continued

| | Process condition | | | Performance evaluation | | | | | | | | | | | | |
|---|---|---|---|---|---|---|---|---|---|---|---|---|---|---|---|---|
| No. | Steel sheet | Coating weight ($mg/m^2$) | PMT (° C.) | Heat discoloration resistance | Heat cracking resistance | Planar part anti-corrosion property | Corrosion resistance after degreasing | Blackening resistance | Stack blackening resistance | Anti-water stain property | Solvent resistance | Perspiration resistance | Coating adhesion property | Lubricity | Storage stability | Category |
| 93 | III | 900 | 110 | B− | B− | A | A | A | A | A | A | A | A | A | A | Example |
| 94 | III | 900 | 110 | B− | B− | A | A | A | A | A | A | A | A | A | A | Example |
| 95 | III | 900 | 110 | B− | B− | A | A | A | A | A | A | A | A | A | B | Example |
| 96 | III | 900 | 110 | B− | B− | A | A | A | A | A | A | A | A | A | B | Example |
| 97 | III | 900 | 110 | B− | B− | A | A | A | A | A | A | A | A | A | A | Example |
| 98 | III | 900 | 110 | B− | B− | A | A | A | A | A | A | A | A | A | A | Example |
| 99 | III | 900 | 110 | B− | B− | A | A | A | A | A | A | A | A | A | A | Example |
| 100 | III | 900 | 110 | B− | B− | A | A | A | A | A | A | A | A | A | B | Example |
| 101 | I | 900 | 110 | B− | B− | A | A | A | A | A | A | A | A | A | A | Example |
| 102 | II | 900 | 110 | B− | B− | A | A | A | A | A | A | A | A | A | A | Example |
| 103 | IV | 900 | 110 | B− | B− | A | A | A | A | A | A | A | A | A | A | Example |
| 104 | V | 900 | 110 | B− | B− | A | A | A | A | A | A | A | A | A | A | Example |
| 105 | III | 900 | 110 | B− | B− | A | A | A | A | A | A | A | A | A | A | Example |
| 106 | III | 900 | 110 | B− | B− | A | A | A | A | A | A | A | A | A | A | Example |
| 107 | III | 900 | 110 | B | B | A | A | A | B= | A | A | A | A | A | A | Example |
| 108 | III | 900 | 110 | B | B | A | A | A | B= | A | A | A | A | A | A | Example |
| 109 | III | 900 | 110 | B | B | A | A | A | B= | A | A | A | A | A | A | Example |
| 110 | III | 900 | 110 | B | B | A | A | A | B= | A | A | A | A | A | A | Example |
| 111 | III | 900 | 110 | B | B | A | A | A | B= | A | A | A | A | A | B | Example |
| 112 | III | 900 | 110 | B | B | A | A | A | B= | A | A | A | A | A | A | Example |
| 113 | III | 900 | 110 | B | B | A | A | A | B= | A | A | A | A | A | A | Example |
| 114 | III | 900 | 110 | B | B | A | A | A | B= | A | A | A | A | A | A | Example |
| 115 | III | 900 | 110 | B | B | A | A | A | B= | A | A | A | A | A | B | Example |
| 116 | I | 900 | 110 | B | B | A | A | A | B= | A | A | A | A | A | A | Example |
| 117 | II | 900 | 110 | B | B | A | A | A | B= | A | A | A | A | A | A | Example |
| 118 | IV | 900 | 110 | B | B | A | A | A | B= | A | A | A | A | A | A | Example |
| 119 | V | 900 | 110 | B | B | A | A | A | B= | A | A | A | A | A | A | Example |
| 120 | III | 900 | 110 | B | B | A | A | A | B= | A | A | A | A | A | A | Example |
| 121 | III | 900 | 110 | B | B | A | A | A | B= | A | A | A | A | A | A | Example |
| 122 | III | 900 | 110 | B | B | B | B | A | B= | A | A | A | B | A | A | Example |
| 123 | III | 50 | 110 | B− | B− | B− | B− | B− | B− | B− | B− | B− | B− | B | A | Example |
| 124 | III | 300 | 110 | B− | B− | B | B | B | B | B | B | B | B | B | A | Example |
| 125 | III | 600 | 110 | B− | B− | A | A | A | A | A | A | A | A | B | A | Example |
| 126 | III | 1200 | 110 | B− | B− | A | A | A | A | A | A | A | A | B | A | Example |
| 127 | III | 1600 | 110 | B= | B= | A | A | A | A | A | A | A | A | B | A | Example |
| 128 | III | 2000 | 110 | B= | B= | A | A | A | A | A | A | A | A | A | A | Example |
| 129 | III | 900 | 60 | B− | B− | B− | B− | B− | B− | B− | B− | B− | A | B | A | Example |
| 130 | III | 900 | 80 | B− | B− | B | B | B | B | B | B | B | A | B | A | Example |
| 131 | III | 900 | 180 | B− | B− | B | B | B | B | B | B | B | B | B | A | Example |
| 132 | III | 900 | 200 | B− | B− | B− | B− | B− | B− | B− | B− | B− | B− | B | A | Example |
| 133 | I | 900 | 110 | B− | B− | A | A | A | A | A | A | A | A | B | A | Example |
| 134 | II | 900 | 110 | B− | B− | A | A | A | A | A | A | A | A | B | A | Example |
| 135 | IV | 900 | 110 | B− | B− | A | A | A | A | A | A | A | A | B | A | Example |
| 136 | V | 900 | 110 | B− | B− | A | A | A | A | A | A | A | A | B | A | Example |
| 137 | III | 900 | 110 | B− | B | D | D | A | A | A | A | A | A | B | A | Comparative Example |

TABLE 3-continued

| | Process condition | | | Performance evaluation | | | | | | | | | | | | |
|---|---|---|---|---|---|---|---|---|---|---|---|---|---|---|---|---|
| No. | Steel sheet | Coating weight ($mg/m^2$) | PMT (° C.) | Heat discoloration resistance | Heat cracking resistance | Planar part anti-corrosion property | Corrosion resistance after degreasing | Blackening resistance | Stack blackening resistance | Anti-water stain property | Solvent resistance | Perspiration resistance | Coating adhesion property | Lubricity | Storage stability | Category |
| 138 | III | 900 | 110 | B− | D | A | A | A | A | A | A | A | A | B | A | Comparative Example |
| 139 | III | 900 | 110 | C | C | D | D | B− | D | D | A | D | A | B | A | Comparative Example |
| 140 | III | 900 | 110 | D | D | A | A | C | D | C | A | C | C | B− | A | Comparative Example |
| 141 | III | 900 | 110 | B | B | D | D | A | A | A | A | A | A | B | A | Comparative Example |
| 142 | III | 900 | 110 | B− | B− | A | A | D | D | A | A | A | A | B | A | Comparative Example |
| 143 | III | 900 | 110 | B− | B | C | C | A | A | A | A | A | A | B | A | Comparative Example |
| 144 | III | 900 | 110 | B− | C | A | A | A | A | A | A | A | A | B | A | Comparative Example |
| 145 | III | 900 | 110 | B− | C | A | A | A | A | A | A | A | A | B | A | Comparative Example |
| 146 | III | 900 | 110 | B− | B− | D | D | A | B− | B− | A | B− | A | B | A | Comparative Example |
| 147 | III | 900 | 110 | B= | B= | C | C | A | C | B | A | B | A | B | A | Comparative Example |
| 148 | III | 900 | 110 | B− | B− | A | A | A | A | A | A | A | C | B | B− | Comparative Example |
| 149 | III | 900 | 110 | B− | B− | C | C | A | A | A | C | A | A | B | A | Comparative Example |
| 150 | III | 900 | 110 | C | C | A | A | C | C | C | A | C | B | B− | A | Comparative Example |
| 151 | III | 900 | 110 | B− | B− | C | C | A | A | A | A | A | A | B | A | Comparative Example |
| 152 | III | 900 | 110 | C | C | A | A | C | C | C | A | C | C | B | B | Comparative Example |
| 153 | III | 900 | 110 | D | D | A | A | D | D | D | A | D | D | B | B− | Comparative Example |
| 154 | III | 900 | 110 | B− | B− | A | A | C | C | A | A | A | A | B | A | Comparative Example |
| 155 | III | 900 | 110 | B− | B− | C | C | A | A | A | A | A | A | B | B− | Comparative Example |
| 156 | III | 900 | 110 | B | B | A | A | A | B= | A | A | A | A | B | A | Example |
| 157 | III | 900 | 110 | B | B | A | A | A | B= | A | A | A | A | A | A | Example |
| 158 | III | 900 | 110 | B− | B− | A | A | A | A | A | D | A | A | B | A | Comparative Example |
| 159 | III | 900 | 110 | B− | B− | A | A | A | A | A | C | A | A | B | A | Comparative Example |

TABLE 3-continued

| | Process condition | | | Performance evaluation | | | | | | | | | | | | |
|---|---|---|---|---|---|---|---|---|---|---|---|---|---|---|---|---|
| No. | Steel sheet | Coating weight ($mg/m^2$) | PMT (° C.) | Heat discoloration resistance | Heat cracking resistance | Planar part anti-corrosion property | Corrosion resistance after degreasing | Blackening resistance | Stack blackening resistance | Anti-water stain property | Solvent resistance | Perspiration resistance | Coating adhesion property | Lubricity | Storage stability | Category |
| 160 | III | 900 | 110 | B− | B− | A | A | A | A | A | A | A | C | B | A | Comparative Example |
| 161 | III | 900 | 110 | Test canceled because preparation of a surface-treatment solution failed. | | | | | | | | | | | D | Comparative Example |
| 162 | III | 900 | 110 | B− | B− | D | D | A | A | A | A | A | A | B | C | Comparative Example |

As listed in Tables 2 and 3, our examples are excellent in all of heat discoloration resistance, heat cracking resistance, planar part anti-corrosion property, corrosion resistance after alkali degreasing, blackening resistance, anti-water stain property, solvent resistance, perspiration resistance, coating adhesion property, and storage stability, and even in stack blackening resistance evaluated in a more severe environment. In contrast, the comparative examples outside the appropriate ranges required by the present disclosure in terms of any of the requirements disclosed herein were insufficient in any of the above-mentioned properties. In addition, in Comparative Example No. 161, due to a low pH, a surface-treatment solution could not be prepared and sample sheet evaluation could not be made.

Example 2

The same operations were performed as described above in the (1) Sample sheet, (2) Pre-treatment (cleaning), and (3) Surface-treatment solution sections in Example 1.

(4) Treatment Method

On each sample sheet after the pre-treatment listed in the "Steel sheet" column in Table 4, a surface-treatment solution No. 93 in Table 2 was applied with a bar coater, and the sample sheet was then placed in an oven without being washed with water to form a surface-coating layer having a coating weight (per side) of 900 mg/m$^2$ on one surface thereof. At this time, the temperature of the sample sheet and the temperature of the surface-treatment solution in applying the surface-treatment solution are represented by $T_S$ and $T_L$, respectively, and $T_S$–$T_L$ is represented by ΔT, as seen in Table 4. Regarding the drying of the surface-treatment solution, the preliminary drying time t (sec) before the sample sheet is placed in the oven and the peak metal temperature PMT in the subsequent heat drying in the oven are also listed in Table 4. The coating weight was determined by quantitatively determining the Zr of the compounded zirconium carbonate compound (C) by a fluorescent X-ray analyzer and converting it from the Zr coating weight to the layer coating weight.

(5) Evaluation Test Method

In addition to the evaluations in (5-1) to (5-12) in Example 1, each obtained zinc or zinc alloy coated steel sheet with a surface-coating layer (hereinafter referred to simply as a "sample") was subjected to evaluations of (5-13) and (5-14), and the results are listed in Table 4. Evaluation criteria C and D are not preferable due to insufficient performance.

(5-13) High Planar Part Anti-Corrosion Property

Each sample was subjected to a salt spray test (SST) according to JIS-Z-2371-2000, in a planar state without being pressed. The planar part anti-corrosion property was evaluated based on the white rust area ratio after 480 hours. The evaluation criteria are as follows.

(Evaluation Criteria)

A: white rust area ratio being less than 5%

B: white rust area ratio being 5% or more and less than 10%

B-: white rust area ratio being 10% or more and less than 25%

C: white rust area ratio being 25% or more and less than 50%

D: white rust area ratio being 50% or more and 100% or less (5-14) Layer Phase Analysis SEM observation was carried out to examine the surface of the surface-coating layer of each sample. Using an Everhart-Thornley type detector with an accelerating voltage of 1 kV, secondary electron images were observed. At 20,000 times observation magnification (about 6 μm×4 μm as an observation area), each image was captured as a digital image of 1024×700 pixels in gray scale of 256 gradations. In each observed image, a phase made of a Zr-containing inorganic material appears bright and a phase made of a Zr-free resin component dark. Accordingly, as the proportion of a Zr-containing phase, the area ratio of a region observed to be bright was determined and considered as the volume fraction according to the following procedure.

(A): To remove noise, apply smoothing processing to the acquired SEM image with a Gaussian filter with an operator size of 1 pixel.

(B): Binarize the image of (A) by the maximum entropy method.

(C): Determine the ratio of the bright area of the binarized image.

TABLE 4

| | Process condition | | | | | | | | Layer structure | Performance evaluation | | |
|---|---|---|---|---|---|---|---|---|---|---|---|---|
| No. | Steel sheet | Sheet temp. in application TS (° C.) | Solution temp. in application TL (° C.) | ΔT (° C.) | Preliminary drying time t (s) | ΔT/t (° C./s) | Coating weight (mg/m$^2$) | PMT (° C.) | Volume fraction of Zr-containing phase (%) | Heat discoloration resistance | Heat cracking resistance | Planar part anti-corrosion property |
| 163 | III | 33 | 25 | 8 | 1 | 8 | 900 | 110 | 12 | B– | B– | A |
| 164 | III | 38 | 25 | 13 | 1 | 13 | 900 | 110 | 19 | B– | B– | A |
| 165 | III | 49 | 25 | 24 | 0.6 | 40 | 900 | 110 | 33 | B– | B– | A |
| 166 | III | 33 | 25 | 8 | 0.12 | 67 | 900 | 110 | 47 | B– | B– | A |
| 167 | III | 47 | 25 | 22 | 60 | 0.37 | 900 | 110 | 4 | B– | B– | A |
| 168 | III | 25 | 25 | 0 | 1 | 0 | 900 | 110 | 3 | B– | B– | A |
| 169 | III | 72 | 25 | 47 | 5 | 9.4 | 900 | 110 | 45 | B– | B– | A |

| | Performance evaluation | | | | | | | | | | |
|---|---|---|---|---|---|---|---|---|---|---|---|
| No. | High planar part anti-corrosion property | Corrosion resistance after degreasing | Blackening resistance | Stack blackening resistance | Anti-water stain property | Solvent resistance | Perspiration resistance | Coating adhesion property | Lubricity | Storage stability | Category |
| 163 | A | A | A | A | A | A | A | A | A | A | Example |
| 164 | A | A | A | A | A | A | A | A | A | A | Example |
| 165 | B | A | A | A | A | A | A | A | A | A | Example |
| 166 | C | A | A | A | A | A | A | A | A | A | Example |

TABLE 4-continued

| | | | | | | | | | | | |
|---|---|---|---|---|---|---|---|---|---|---|---|
| 167 | C | A | A | A | A | A | A | A | A | A | Example |
| 168 | C | A | A | A | A | A | A | A | A | A | Example |
| 169 | C | A | A | A | A | A | A | A | A | A | Example |

As can be seen from Table 4, some of our examples were also excellent in high planar part anti-corrosion property, where the volume fraction of a Zr-containing phase was adjusted in the range of 5% to 40% by controlling the temperature condition at the time of application and the preliminary drying condition before heating and drying within the predetermined ranges.

For instance, FIG. 1 presents an SEM image of a surface of a surface-coating layer. A secondary electron image was observed using an Everhart-Thornley secondary electron detector with an accelerating voltage of 1 kV. It can be seen that Zr-containing regions of bright contrast are dispersed in Zr-free regions of dark contrast. For this field of view, binarization was performed by the maximum entropy method, and the area ratio of the Zr-containing phase (bright regions) was found to be 19%.

INDUSTRIAL APPLICABILITY

The zinc or zinc alloy coated steel sheet with a surface-coating layer produced by using the surface-treatment solution according to the disclosure is suitable for various applications such as for use as a member to be subjected to arc welding, but also for steel sheets for household electrical appliances, steel sheets for building materials, and steel sheets for automobiles.

The invention claimed is:

1. A surface-treatment solution for a zinc or zinc alloy coated steel sheet containing a glycidyl group-containing silane coupling agent (A), a tetraalkoxysilane (B), a zirconium carbonate compound (C), and an anionic polyurethane resin (D) having a glass transition temperature (Tg) of 80° C. to 130° C., a vanadium compound (E), a molybdic acid compound (F), and water, the surface-treatment solution having a pH of 8.0 to 10.0, and the amount of each component satisfying:

(1) a mass ratio ($X_S/D_S$) of a total mass ($X_S$) of a solid content mass ($A_S$) of the glycidyl group-containing silane coupling agent (A), a solid content mass ($B_S$) of the tetraalkoxysilane (B), and a $ZrO_2$ equivalent mass ($C_Z$) in the zirconium carbonate compound (C) to a solid content mass ($D_S$) of the anionic polyurethane resin (D) is from 0.05 to 0.35;

(2) a mass ratio ($A_S/X_S$) of the solid content mass ($A_S$) of the glycidyl group-containing silane coupling agent (A) to the total mass ($X_S$) is from 0.20 to 0.40;

(3) a mass ratio ($B_S/X_S$) of the solid content mass ($B_S$) of the tetraalkoxysilane (B) to the total mass ($X_S$) is from 0.010 to 0.30;

(4) a mass ratio ($C_Z/X_S$) of the $ZrO_2$ equivalent mass ($C_Z$) in the zirconium carbonate compound (C) to the total mass ($X_S$) is from 0.45 to 0.70;

(5) a mass ratio ($E_V/(X_S+D_S)$) of a V equivalent mass ($E_V$) in the vanadium compound (E) to a total mass ($X_S+D_S$) of the total mass ($X_S$) and the solid content mass ($D_S$) of the anionic polyurethane resin (D) is from 0.0010 to 0.015; and (6) a mass ratio ($F_M/(X_S+D_S)$) of a Mo equivalent mass ($F_M$) in the molybdic acid compound (F) to the total mass ($X_S+D_S$) of the total mass ($X_S$) and the solid content mass ($D_S$) of the anionic polyurethane resin (D) is from 0.0010 to 0.015.

2. The surface-treatment solution for a zinc or zinc alloy coated steel sheet according to claim 1, further containing a sodium silicate (G), wherein the amount thereof satisfies:

(7) a mass ratio ($G_S/(X_S+G_S)$) of a solid content mass ($G_S$) of the sodium silicate (G) to the total mass ($X_S+G_S$) of the total mass ($X_S$) and the solid content mass ($G_S$) of the sodium silicate (G) is less than 0.05, inclusive of 0.00.

3. The surface-treatment solution for a zinc or zinc alloy coated steel sheet according to claim 1, further containing a wax (H), wherein the amount thereof satisfies:

(8) a mass ratio ($H_S/(X_S+D_S)$) of a solid content mass ($H_S$) of the wax (H) to the total mass ($X_S+D_S$) of the total mass ($X_S$) and the solid content mass ($D_S$) of the anionic polyurethane resin (D) is from 0.002 to 0.10.

4. The surface-treatment solution for a zinc or zinc alloy coated steel sheet according to claim 2, further containing a wax (H), wherein the amount thereof satisfies:

(8) a mass ratio ($H_S/(X_S+D_S)$) of a solid content mass ($H_S$) of the wax (H) to the total mass ($X_S+D_S$) of the total mass ($X_S$) and the solid content mass ($D_S$) of the anionic polyurethane resin (D) is from 0.002 to 0.10.

5. A method of producing a zinc or zinc alloy coated steel sheet with a surface-coating layer, comprising:

a first step of applying the surface-treatment solution as recited in claim 1 to a surface of a zinc or zinc alloy coated steel sheet; and a second step of subsequently drying the applied surface-treatment solution to form a surface-coating layer having a coating weight of 50 mg/m$^2$ to 2,000 mg/m$^2$.

6. The method of producing a zinc or zinc alloy coated steel sheet with a surface-coating layer according to claim 5, wherein $T_S$ is 15° C. to 55° C., $T_L$ is 10° C. to 40° C., and $\Delta T$ is 5° C. to 40° C., where $T_S$ and $T_L$ represent a temperature of the zinc or zinc alloy coated steel sheet and a temperature of the surface-treatment solution in the first step, respectively, and $\Delta T$ represents $T_S$31 $T_L$, and the second step includes a preliminary drying step of drying the applied surface-treatment solution in the atmosphere for a time t seconds, and a heating and drying step of subsequently heating and drying the applied surface-treatment solution in a drying furnace, wherein $\Delta T/t$ is 1° C./s to 60° C./s.

7. A zinc or zinc alloy coated steel sheet with a surface-coating layer, comprising:

a zinc or zinc alloy coated steel sheet; and a surface-coating layer having a coating weight of 50 mg/m$^2$ to 2,000 mg/m$^2$ obtained by applying the surface-treatment solution as recited in claim 1 to a surface of the zinc or zinc alloy coated steel sheet, and drying the applied surface-treatment solution.

8. The zinc or zinc alloy coated steel sheet with a surface-coating layer according to claim 7, wherein the surface-coating layer is formed by a Zr-containing phase and a Zr-free phase, and the Zr-containing phase has a volume fraction of 5% to 40%.

9. The zinc or zinc alloy coated steel sheet with a surface-coating layer according to claim 7, wherein the zinc or zinc alloy coated steel sheet is a hot-dip Zn—Al alloy coated steel sheet comprising a hot-dip Zn—Al alloy coated layer formed on at least one surface of a base steel sheet, the hot-dip Zn—Al alloy coated layer containing, by mass %, Al: 3.0% to 6.0%, Mg: 0.2% to 1.0%, and Ni: 0.01% to 0.10%, with the balance being Zn and inevitable impurities.

10. The zinc or zinc alloy coated steel sheet with a surface-coating layer according to claim 8, wherein the zinc or zinc alloy coated steel sheet is a hot-dip Zn—Al alloy coated steel sheet comprising a hot-dip Zn—Al alloy coated layer formed on at least one surface of a base steel sheet, the hot-dip Zn—Al alloy coated layer containing, by mass %, Al: 3.0% to 6.0%, Mg: 0.2% to 1.0%, and Ni: 0.01% to 0.10%, with the balance being Zn and inevitable impurities.

* * * * *